US010502430B1

(12) United States Patent
Alvey et al.

(10) Patent No.: US 10,502,430 B1
(45) Date of Patent: Dec. 10, 2019

(54) PARTICULATES DETECTION IN A COOKING INSTRUMENT

(71) Applicant: Brava Home, Inc., Redwood City, CA (US)

(72) Inventors: Justin Alvey, San Francisco, CA (US); Shih-Yu Cheng, San Carlos, CA (US)

(73) Assignee: BRAVA HOME, INC., Redwood City, CA (US)

( * ) Notice: Subject to any disclaimer, the term of this patent is extended or adjusted under 35 U.S.C. 154(b) by 0 days.

(21) Appl. No.: 16/157,041

(22) Filed: Oct. 10, 2018

(51) Int. Cl.

| | |
|---|---|
| ***F24C 7/08*** | (2006.01) |
| ***F24C 7/06*** | (2006.01) |
| ***F24C 15/00*** | (2006.01) |
| ***F27D 21/04*** | (2006.01) |
| *F27D 21/02* | (2006.01) |
| *F27D 19/00* | (2006.01) |

(52) U.S. Cl.
CPC ..... *F24C 7/085* (2013.01); *F24C 7/062* (2013.01); *F24C 15/003* (2013.01); *F24C 15/008* (2013.01); *F27D 21/04* (2013.01); *F27D 2019/0006* (2013.01); *F27D 2021/026* (2013.01)

(58) Field of Classification Search
CPC ..... F24C 7/085; F24C 7/062; F24C 15/003; F24C 15/008; F27D 21/04; F27D 2013/0006; F27D 2021/026
See application file for complete search history.

(56) References Cited

U.S. PATENT DOCUMENTS

| | | | | |
|---|---|---|---|---|
| 3,407,285 | A | 10/1968 | Jacobs | |
| 4,117,294 | A | 9/1978 | Appelquist et al. | |
| 4,335,293 | A * | 6/1982 | Kobayashi | G05D 22/02 219/707 |
| 4,473,732 | A | 9/1984 | Payne | |
| 4,475,024 | A | 10/1984 | Tateda et al. | |
| 4,771,154 | A | 9/1988 | Bell et al. | |
| 4,800,090 | A | 1/1989 | August | |
| 5,349,163 | A * | 9/1994 | An | H05B 6/6458 219/491 |
| 5,665,259 | A | 9/1997 | Westerberg | |
| 5,990,454 | A | 11/1999 | Westerberg et al. | |
| 6,011,242 | A | 1/2000 | Westerberg | |
| 6,013,900 | A | 1/2000 | Westerberg et al. | |
| 6,069,345 | A | 5/2000 | Westerberg | |
| 6,302,095 | B1 | 10/2001 | Tolley et al. | |

(Continued)

FOREIGN PATENT DOCUMENTS

| | | |
|---|---|---|
| CN | 101398197 | 4/2009 |
| EP | 1740018 | 1/2007 |

(Continued)

*Primary Examiner* — Shawntina T Fuqua
(74) *Attorney, Agent, or Firm* — Haynes and Boone, LLP

(57) ABSTRACT

Several embodiments include a cooking instrument. The cooking instrument can include a heating system. The heating system can include one or more heating elements capable of emitting wireless energy into the cooking chamber. The sensor can be positioned, configured, or shaped such that air within the cooking chamber flows over the sensor. The sensor can be adapted to detect particles given off by food under heat. The cooking instrument can also include a sensor and a control system. The control system can be configured to execute a heating process and determine a stage of the heating process based on sensor data from the sensor.

22 Claims, 13 Drawing Sheets

(56) References Cited

U.S. PATENT DOCUMENTS

| | | | |
|---|---|---|---|
| 6,417,494 | B1 | 7/2002 | Westerberg et al. |
| 6,843,207 | B2 | 1/2005 | Kanzaki et al. |
| 7,075,442 | B2 | 7/2006 | Lion et al. |
| D541,578 | S | 5/2007 | Jeon |
| 7,323,663 | B2 | 1/2008 | Cavada et al. |
| D586,180 | S | 2/2009 | Pino et al. |
| D602,306 | S | 10/2009 | Lavy |
| 7,619,186 | B2 | 11/2009 | Cavada et al. |
| 7,683,292 | B2 | 3/2010 | Cavada et al. |
| D629,639 | S | 12/2010 | Fernandez et al. |
| 8,200,548 | B2 | 6/2012 | Wiedl |
| 8,791,398 | B2 | 7/2014 | De la Cuerda Ortin et al. |
| 8,929,724 | B1 | 1/2015 | Mograbi |
| 9,414,444 | B2 | 8/2016 | Libman et al. |
| 9,460,633 | B2 | 10/2016 | Minvielle |
| D771,995 | S | 11/2016 | Bhogal et al. |
| D771,996 | S | 11/2016 | Bhogal et al. |
| 9,528,972 | B2 | 12/2016 | Minvielle |
| D777,504 | S | 1/2017 | Bhogal et al. |
| D782,864 | S | 4/2017 | Bhogal et al. |
| D783,336 | S | 4/2017 | Suh et al. |
| D802,996 | S | 11/2017 | Bhogal et al. |
| 9,927,129 | B2 | 3/2018 | Bhogal et al. |
| 2002/0171674 | A1 | 11/2002 | Paris |
| 2005/0173400 | A1 | 8/2005 | Cavada et al. |
| 2006/0289436 | A1 | 12/2006 | Carbone et al. |
| 2008/0259995 | A1 | 10/2008 | Kuhn et al. |
| 2009/0034944 | A1 | 2/2009 | Burtea et al. |
| 2009/0102083 | A1 | 4/2009 | Cochran et al. |
| 2009/0272814 | A1 | 11/2009 | Granhed et al. |
| 2010/0186600 | A1 | 7/2010 | Lewis et al. |
| 2010/0199857 | A1 | 8/2010 | Storiz et al. |
| 2011/0002675 | A1 | 1/2011 | Cochran et al. |
| 2011/0002677 | A1 | 1/2011 | Cochran et al. |
| 2011/0114627 | A1 | 5/2011 | Burt |
| 2011/0114633 | A1 | 5/2011 | Niklasson et al. |
| 2012/0063753 | A1 | 3/2012 | Cochran et al. |
| 2012/0180775 | A1 | 7/2012 | Waltz et al. |
| 2013/0202754 | A1 | 8/2013 | Cochran et al. |
| 2016/0033140 | A1* | 2/2016 | Weaver, Jr. ..... F24C 14/00 99/342 |
| 2016/0327279 | A1 | 11/2016 | Bhogal et al. |
| 2016/0348918 | A1 | 12/2016 | Bhogal et al. |
| 2017/0074522 | A1 | 3/2017 | Cheng et al. |
| 2017/0099988 | A1 | 4/2017 | Matloubian et al. |
| 2017/0211819 | A1 | 7/2017 | McKee et al. |
| 2017/0215233 | A1 | 7/2017 | Katz et al. |

FOREIGN PATENT DOCUMENTS

| | | |
|---|---|---|
| EP | 2515044 | 10/2012 |
| RU | 2006102663 | 8/2007 |
| RU | 2007111953 | 10/2008 |
| RU | 2008111110 | 9/2009 |
| RU | 110892 | 11/2011 |
| WO | WO 98/030941 | 7/1998 |
| WO | WO 2014/086487 | 6/2014 |
| WO | WO 2017/044876 | 3/2017 |

* cited by examiner

PARTICULATES DETECTION IN A COOKING INSTRUMENT

TECHNICAL FIELD

Various embodiments relate to cooking instruments, such as ovens.

BACKGROUND

The art of cooking remains an "art" at least partially because of the food industry's inability to help cooks to produce systematically award worthy dishes. To make a full course meal, a cook often has to use multiple cooking instruments, understand the heating patterns of the cooking instruments, and make dynamic decisions throughout the entire cooking process based on the cook's observation of the target food's progression (e.g., transformation due to cooking/heating). Because of this, while some low-end meals can be microwaved (e.g., microwavable meals) or quickly produced (e.g., instant noodles), traditionally, truly complex meals (e.g., steak, kebabs, sophisticated dessert, etc.) cannot be produced systematically using conventional cooking instruments automatically. The industry has yet been able to create an intelligent cooking instrument capable of automatically and consistently producing complex meals with precision, speed, and lack of unnecessary human intervention.

Figure 1:
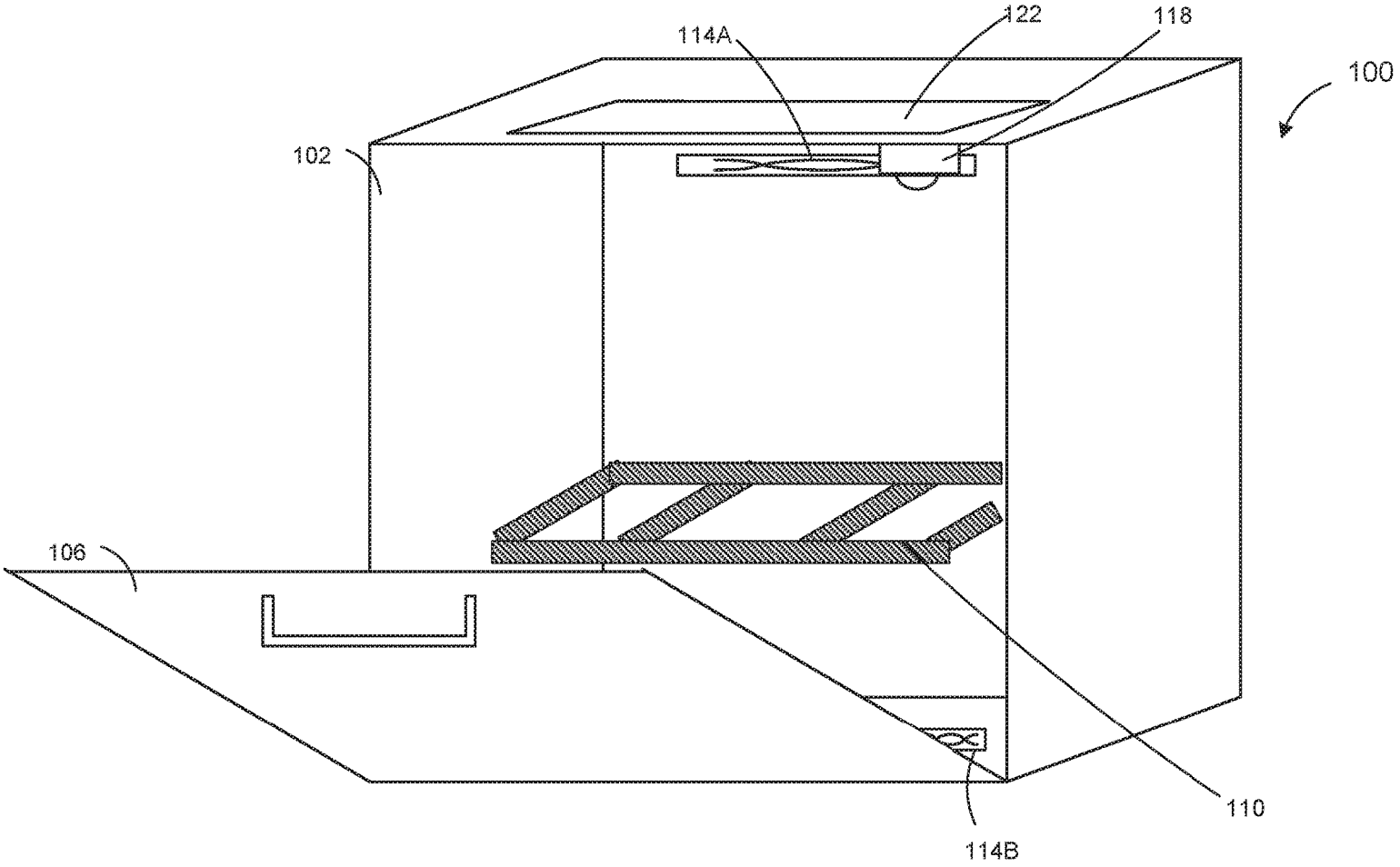
FIG. 1 is a structural diagram of a perspective view of a cooking instrument, in accordance with various embodiments.

The figures depict various embodiments of this disclosure for purposes of illustration only. One skilled in the art will readily recognize from the following discussion that alternative embodiments of the structures and methods illustrated herein may be employed without departing from the principles of embodiments described herein.

DETAILED DESCRIPTION

A conventional cooking instrument can only execute static heating processes. That is, a conventional cooking instrument can turn on or off on a particular heater for a preconfigured duration to cook its target food. Several embodiments herein include a cooking instrument capable of executing dynamic heating processes. In these embodiments, the cooking instrument is capable of determining stages of the heating processes and adjusting each heating step in response. The determined stage can be indicative of a state of the food (e.g., how well cooked is the food or a portion or a surface of the food), a state of one or more heating elements, a state of a cooking platform, a state of air inside a cooking chamber, or any combination thereof. In turn, the combination of these states can be used as inputs to recipes and/or control algorithms for a control system to configure a heating system of the cooking instrument on the fly while the heating process is underway (e.g., being executed).

The cooking instrument can detect cooking stages of food by sensing particles in the air. In some cases, if the cooking chamber is completely sealed, an air particulates sensor would be measuring the cumulative particulates instead of the particulates generated from real-time physical transformation of items within the cooking chamber. Therefore in some embodiments, the cooking instrument includes an exhaust structure to move the air to a sensor to measure the particulates generated from such physical transformations. In one example, the cooking instrument can include a fan or other air movement device(s) that drives the air to the sensor through the exhaust structure. In other examples, the exhaust structure can rely on differences in air pressure to move air.

In some examples, the exhaust structure includes a pipe. For example, the pipe can pull air from one region (e.g., the top) of the cooking chamber to a cooler region. In these examples, the particulates sensor can include a light source and a light sensor (e.g., housed together or as separate components in a sensor system). The light source can shine light toward air moving through or out of the pipe. The light sensor can be positioned near or at the end of the pipe, and can measure light scattering off of particles in the air moving through or out of the pipe.

In some examples, the particulates sensor can be placed in a configuration such that the exhausted air from the cooking instrument passes through or over it. This configuration advantageously enables the air to cool down for better tolerance by the particulates sensor and enables water vapor and grease spray to be removed, thus extending life of the particulates sensor. This configuration further advantageously provides a more accurate and well mixed sampling of air from the cooking chamber and provides a known air speed of particles through the sensor area which can then be used for calculating the particle size and concentration as it passes the particulates sensor.

In several embodiments, a control system of the cooking instrument can utilize the output of the particulates sensor to identify and/or quantify particles given off by food under heat (e.g., when the control system is driving the heating system to be on) and use the identified particulates to detect different stages of the cooking process. For example, the control system can first determine the size distribution and/or respective quantity of air particles from sensor readings from the particulates sensor. The control system can then use the size distribution and quantity of such particles to compute information about the cooking stage or other indicators for detecting issues or anomalies with the cooking process. For another example, the control system can use particle size ratio to differentiate between burning of different materials, searing stages, chemical reactions, phase transformation of oil or water, or any combination thereof.

In some embodiments, besides the particulates sensor, the cooking instrument can include a temperature sensor and/or a humidity sensor. A control system of the cooking instrument can use the temperature and/or humidity readings from the respective sensors to inform the control system to provide correction to the particulate readings when the particulates sensor is measuring steam particles. Using the combination of the temperature sensor, humidity sensor, the particulates sensor, or any combination thereof, the control system can better confirm stages of cooking (e.g., by relative moisture content of exhausted air).

In some embodiments, the cooking instrument can utilize a particulates sensor that includes a laser and a light sensor. The light sensor can detect the scattering of light from the laser by individual particles passing through an area targeted by the laser. A control system of the cooking instrument can run one or more algorithms to determine the size and quantity of particles from the light sensor readings. In some embodiments, the output of the algorithms and/or the light sensor readings can provide feedback to the control system such that it can automatically stop or reduce heat from a heating system to prevent overcooking or burning (e.g., in response to detecting an anomaly pattern based on the feedback).

In some embodiments, the cooking instrument can implement a user-configurable alert or limit associated with a particulate type and/or a particulate amount. In one example, the alert or limit can be entered by a user via a user interface implemented by a control system of the cooking instrument. In another example, the alert or limit can be generated by the control system based on a user's indicated room size, ventilation type, and/or smoke detector placement. The control system can monitor the output of the particulates sensor and compute a particulate quantity and type. Based on the computed particulate quantity and type, the control system can determine whether the conditions of the user-configurable alert or limit is met. In some cases, in response to determining that the conditions of the alert or limit are met, the control system can notify the user (e.g., via a display, a network message, or an auditory message). In some cases, in response to determining that the conditions are met, the control system can back-off (e.g., reduce heat or turn off heat) a heating system of the cooking instrument. For example, the conditions of the alert or limit can be indicative of smoke being generated in quantities that is likely to set-off a smoke detector. In some embodiments, a control system of the cooking instrument can calculate smoke exhausted over time based on the particulates sensor readings and correlation between the aggregate smoke amount and smoke detector limit(s) to accurately time alerts to users of the cooking instrument to help the user avoid triggering the smoke alarm.

In some embodiments, the cooking instrument can cook food that is spread over multiple zones by individually focusing heat on each zone until a predetermined particle level (e.g., predetermined threshold quantity of all particles or one or more preset types of particulate) is reached. The predetermined particle level can be associated with chemical changes representing the "doneness" of a particular foodstuff has taken place. "Doneness" is a state of the foodstuff that is known to be both edible and tasty. By iteratively heating each zone and measuring particle level from the entire cooking chamber, the cooking instrument advantageously gain an ability to measure the cooking process in each zone, even though the particulates sensor cannot on its own discriminate between zones.

In some embodiments, a control system of the cooking instrument can measure a quantity of particulate within a predetermined time after turning on a heating element. The control system can determine that a surface of the heating element may be dirty in response to determining that the particle level exceeds a predetermined level within a predetermined time after turning on the heating element. In some examples, in response to determining that the heating element is dirty, the control system can instruct (e.g., via a display or a network message) the user on how to clean. In some examples, in response to determining that the heating element is dirty, the control system can run a self-cleaning routine by driving the heating element and/or the rest of the heating system to burn off the dirt or prompt the user to confirm whether to run the self-cleaning routine (e.g., and notifying the user to expect some smoke). In some embodiments, a control system of the cooking instrument can compare measurements from the particulates sensor and data indicative of when one or more heating elements are turned on to infer how far away burning particles are from each of the heating elements.

FIG. 1 is a structural diagram of a perspective view of a cooking instrument 100, in accordance with various embodiments. The cooking instrument 100 can include a cooking chamber 102 having a door 106. At least one cooking platform 110 is disposed inside the cooking chamber 102. The cooking platform 110 can be a tray, a rack, or any combination thereof.

The cooking instrument 100 can include a heating system (not labeled in FIG. 1). The heating system can include one or more heating elements 114 (e.g., a heating element 114A, a heating element 114B, etc., collectively as the "heating elements 114"). The cooking chamber 102 can be lined with the heating elements 114. Each of heating elements 114 can include a wavelength controllable filament assembly. The wavelength controllable filament assembly is capable of independently adjusting an emission spectral power distribution (hence also peak frequency and peak wavelength), emission power, and/or emission signal pattern in response to a command from a computing device (not shown) of the cooking instrument 100.

In several embodiments, the cooking chamber 102 is windowless. That is, the cooking chamber 102, including the door 106, is entirely enclosed without any transparent (and/or semitransparent) parts when the door 106 is closed. For example, the cooking chamber 102 can be sealed within a metal enclosure (e.g., with thermal insulation from/to the outside of the cooking chamber 102) when the door 106 is closed. A camera 118 can be attached to an interior of the cooking chamber 102. In some embodiments, the camera 118 is attached to the door 106. For example, the camera 118 can face inward toward the interior of the cooking chamber 102 when the door 106 is closed and upward when the door 106 is opened as illustrated. In some embodiments, the camera 118 is installed on the ceiling (e.g., top interior surface) of the cooking chamber 102. The camera 118 can be attached to the door 106 or proximate (e.g., within three inches) to the door 106 on the ceiling of the cooking chamber 102 to enable easy cleaning, convenient scanning of labels, privacy, heat damage avoidance, etc.

In several embodiments, each of the heating elements 114 includes one or more wavelength-controllable filament assemblies at one or more locations in the chamber. In some embodiments, each of the one or more wavelength-controllable filament assemblies is capable of independently adjusting its emission spectral power distribution (e.g., peak emission frequency) and/or its emission power. For example, the peak emission frequency of the wavelength-controllable filament assemblies can be tuned within a broad band range (e.g. from 20 terahertz to 300 terahertz). Different frequencies can correspond to different penetration depth for heating the food substances, the cooking platform 110 or other items within the cooking chamber 102, and/or parts of the cooking instrument 100.

The heating elements 114 can be controlled to have varying power, either by using a rapidly switching pulse width modulation (PWM)-like electronics by having a relay-like control that turns on and off relatively quickly compared to the thermal inertia of the heating filament itself. The change in peak emission frequency can be directly correlated with the amount of power delivered into the heating element. More power correlates to higher peak emission frequency. In some cases, the cooking instrument 100 can hold the power constant while lowering the peak emission frequency by activating more heating elements, each at a lower power. The cooking instrument 100 can independently control peak emission frequencies of the filament assemblies and power them by driving these filament assemblies individually.

In some embodiments, using the max power for each individual heating element to achieve the highest emission frequency is challenging because the power consumption may be insufficiently supplied by the AC power supply (e.g., because it would trip the fuse). In some embodiments, this is resolved by sequentially driving each individual heating element at maximum power instead of driving them in parallel with reduced power. Intermediate peak emission frequency can be achieved by having a combination of sequential driving and parallel driving.

In some embodiments, the camera 118 includes an infrared sensor to provide thermal images to the computing device as feedback to a dynamic heating sequence (e.g., a heat adjustment algorithm). In some embodiments, the cooking instrument 100 includes multiple cameras. In some embodiments, the camera 118 includes a protective shell. In some embodiments, the heating elements 114 and the camera 118 are disposed in the cooking chamber 102 such that the camera 118 is not directly between any pairing of the heating elements. For example, the heating elements 114 can be disposed along two vertical walls perpendicular to the door 106. The heating elements 114 can be quartz tubes (e.g., with heating filaments therein) that run horizontally on the vertical walls and perpendicular to the door 106.

In some embodiments, a display 122 is attached to the door 106. In some embodiments, the display 122 is attached to an outward-facing surface of the cooking chamber 102 other than the door 106 (as shown). The display 122 can be a touchscreen display. The display 122 can be attached to an exterior of the cooking chamber 102 on an opposite side of the door 106 from the camera 118. The display 122 can be configured to display a real-time image or a real-time video of the interior of the chamber captured by and/or streamed from the camera 118.

Figure 2:
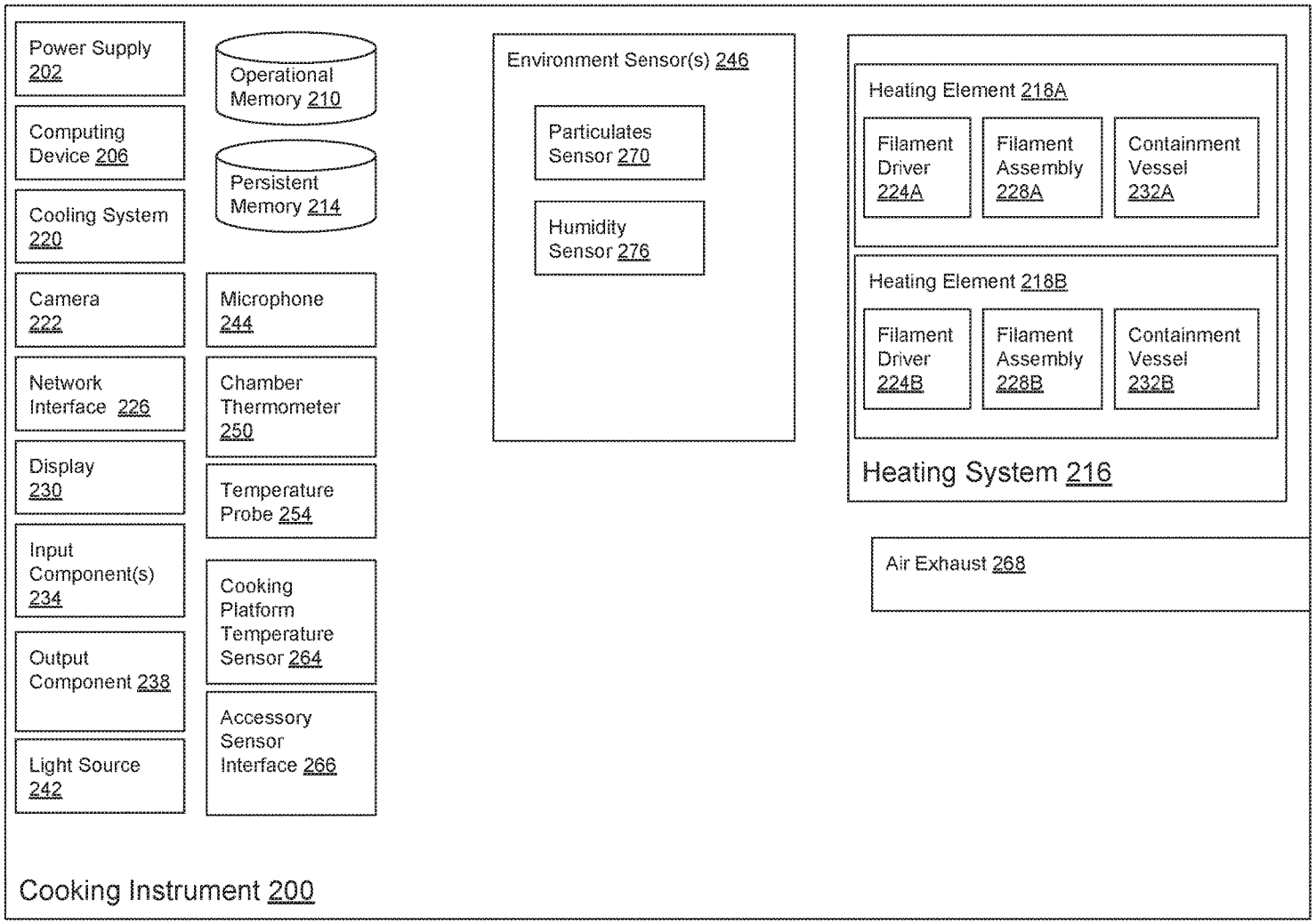
FIG. 2 is a block diagram illustrating physical components of a cooking instrument, in accordance with various embodiments.

FIG. 2 is a block diagram illustrating physical components of a cooking instrument 200 (e.g., the cooking instrument 100), in accordance with various embodiments. The cooking instrument 200 can include a power supply 202, a computing device 206, an operational memory 210, a persistent memory 214, a heating system 216 with one or more heating elements (e.g., a heating element 218A, a heating element 218B, etc., collectively as the "heating elements 218"), a cooling system 220, a camera 222 (e.g., the camera 118), a network interface 226, a display 230 (e.g., the display 122), an input component 234, an output component 238, a light source 242, a microphone 244, one or more environment sensors 246, a chamber thermometer 250, a temperature probe 254, or any combination thereof. The heating elements 218 can be the heating elements 114. In some embodiments, each of the heating elements 218 is individually tunable (e.g., by the computing device 206) to change its emission spectral power distribution independent of others.

The computing device 206, for example, can be a control circuit. The computing device 206 serves as the control system for the cooking instrument 200. The control circuit can be an application-specific integrated circuit or a circuit with a general-purpose processor configured by executable instructions stored in the operational memory 210 and/or the persistent memory 214. The computing device 206 can control all or at least a subset of the physical components and/or functional components of the cooking instrument 200.

The power supply 202 provides the power necessary to operate the physical components of the cooking instrument 200. For example, the power supply 202 can convert alternating current (AC) power to direct current (DC) power for the physical components. In some embodiments, the power supply 202 can run a first powertrain to the heating elements 218 and a second powertrain to the other components. In some cases, the first powertrain is an AC powertrain and the second powertrain is a DC powertrain.

The computing device 206 can control peak wavelengths and/or spectral power distributions (e.g., across different wavelengths) of the heating elements 218. The computing device 206 can implement various functional components (e.g., see FIG. 3) to facilitate operations (e.g., automated or semi-automated operations) of the cooking instrument 200. For example, the persistent memory 214 can store one or more cooking recipes. Each cooking recipe can include one or more heating sequences containing executable instructions (e.g., executable by the computing device 206) to drive the heating elements 218. The operational memory 210 can provide runtime memory to execute the functional components of the computing device 206. In some embodiments, the persistent memory 214 and/or the operational memory 210 can store image files or video files captured by the camera 222.

The heating elements 218 can be wavelength controllable (e.g., capable of changing its spectral power distribution). For example, the heating elements 218 can include quartz tubes, each enclosing one or more heating filaments. In various embodiments, the side of the quartz tubes facing toward the chamber wall instead of the interior of the chamber is coated with a heat resistant coating. The operating temperature of the heating filaments can be extremely high. Hence, the cooling system 220 can provide cooling (e.g., convectional or otherwise) to prevent the heat resistant coating from melting or vaporizing.

The heating elements 218 can respectively include filament drivers (e.g., respectively a filament driver 224A and a filament driver 224B, collectively as the "filament drivers 224"), filament assemblies (e.g., respectively filament assembly 228A and filament assembly 228B, collectively as the "filament assemblies 228B"), and containment vessels (e.g., respectively containment vessel 232A and containment vessel 232B, collectively as the "containment vessels 232"). For example, each heating element can include a filament assembly housed by a containment vessel. The filament assembly can be driven by a filament driver. In turn, the filament driver can be controlled by the computing device 206. For example, the computing device 206 can instruct the power supply 202 to provide a set amount of power to the filament driver. In turn, the computing device 206 can instruct the filament driver to drive the filament assembly to generate electromagnetic waves (i.e., a form of wireless electromagnetic energy) with one or more selected peak wavelengths and/or other particular characteristics defining a spectral power distribution type.

The camera 222 serves various functions in the operation of the cooking instrument 200. For example, the camera 222 and the display 230 together can provide a virtual window to the inside of the chamber despite the cooking instrument 200 being windowless. The camera 222 can serve as a food package label scanner that configures the cooking instrument 200 by recognizing a machine-readable optical label of the food packages. In some embodiments, the camera 222 can enable the computing device 206 to use optical feedback when executing a cooking recipe. In several embodiments, the light source 242 can illuminate the interior of the cooking instrument 200 such that the camera 222 can clearly capture an image of the food substance therein.

The network interface 226 enables the computing device 206 to communicate with external computing devices. For example, the network interface 226 can enable Wi-Fi or Bluetooth. A user device can connect with the computing device 206 directly via the network interface 226 or indirectly via a router or other network devices. The network interface 226 can connect the computing device 206 to an external device with Internet connection, such as a router or a cellular device. In turn, the computing device 206 can have access to a cloud service over the Internet connection. In some embodiments, the network interface 226 can provide cellular access to the Internet.

The display 230, the input component 234, and the output component 238 enable a user to directly interact with the functional components of the computing device 206. For example, the display 230 can present images from the camera 222. The display 230 can also present a control interface implemented by the computing device 206. The input component 234 can be a touch panel overlaid with the display 230 (e.g., collectively as a touchscreen display). In some embodiments, the input component 234 is one or more mechanical devices (e.g., buttons, dials, switches, or any combination thereof). In some embodiments, the output component 238 is the display 230. In some embodiments, the output component 238 is a speaker or one or more external lights.

In some embodiments, the cooking instrument 200 includes the microphone 244, and/or the one or more environment sensors 246. For example, the computing device 206 can utilize the audio signal, similar to images from the camera 222, from the microphone 244 as dynamic feedback to adjust the controls of the heating elements 218 in real-time according to a heat adjustment algorithm (e.g., a part of a dynamic heating sequence). In one example, the computing device 206 can detect an audio signal indicative of a fire alarm, a smoke alarm, popcorn being popped, or any combination thereof. For example, the computing device 206 can adjust the heating system 216 according to the detected audio signal, such as turning off the heating elements 218 in response to detecting an alarm or in response to detecting a series of popcorn noise followed by silence/low noise. The environment sensors 246 can include a pressure sensor, a humidity sensor, a smoke sensor, a pollutant sensor, or any combination thereof. The environment sensors 246 can also include the particulates sensor 270. The computing device 206 can also utilize the outputs of the environment sensors 246 as dynamic feedback to adjust the controls of the heating elements 218 in real-time according to a heating sequence instruction (e.g., a heat adjustment algorithm).

In some embodiments, the cooking instrument 200 includes the chamber thermometer 250, the temperature probe 254, a cooking platform temperature sensor 264, an accessory sensor interface 266, or any combination thereof. The cooking platform temperature sensor 264 can measure the temperature at one or more zones on a cooking platform (e.g., the cooking platform 110). The cooking platform temperature sensor 264 can be embedded in or attached to the cooking platform. The accessory sensor interface 266 can be a wired or wireless interface capable of receiving sensor signals from an accessory of the cooking instrument 200. For example, an accessory (not shown) can include a temperature sensor that reports the temperature experienced at the accessory to the computing device 206. For example, the computing device 206 can utilize the temperature readings from the chamber thermometer 250, the temperature probe 254, the cooking platform temperature sensor 264, the accessory sensor interface 266, or any combination thereof, as dynamic feedback to adjust the controls of the heating elements 218 in real-time according to a heat adjustment algorithm. The temperature probe 254 can be adapted to be inserted into food to be cooked by the cooking instrument 200. The computing device 206 can also utilize the outputs of the temperature probe 254 as dynamic feedback to adjust the controls of the heating elements 218 in real-time according to a heat adjustment algorithm. For example, the heat adjustment algorithm of a cooking recipe can dictate that the food should be heated at a preset temperature for a preset amount time according to the cooking recipe.

Example Implementations

In some example implementations, the heating system 216 includes at least a tunable heating element (e.g., one of the heating elements 218) capable of emitting wireless energy into a cooking chamber (e.g., the cooking chamber 102). To start a process of cooking food, the computing device 206 (e.g., the control system of the cooking instrument 200) can first determine (e.g., identify, select, or infer) a food substance or a food cooking recipe. For example, the computing device 206 can determine the food substance as being in the cooking chamber or intended to be in the cooking chamber. The determination of the food substance can be by image recognition (e.g., using data captured by the camera 222), user input (e.g., using data from the network interface 226 and/or from the input component 234), voice recognition (e.g., using data captured by from a microphone 244), or any combination thereof.

The computing device 206 can be configured to generate, based on an identity of the food substance or the food cooking recipe, a heating sequence to drive the heating system 216. For example, the heating sequence includes or references parameters to determine how to provide power to the tunable heating element to cause the tunable heating element to emit according to a target spectral power distribution. When generating the heating sequence, the target spectral power distribution can be selected to match the absorption spectrum of the food substance or an intermediary cooking medium (e.g., air, cooking platform/tray, water surrounding the food substance, etc.) for cooking the food substance.

In some cases, the computing device 206 can select the food cooking recipe based on identification of food substance by the computing device 206. In some cases, the computing device 206 can infer an expectation of a certain type of food substance to be cooked, in response to receiving a user selection of the food cooking recipe. In some cases, the computing device 206 is configured to generate the heating sequence neither with the identification of food substance nor with an inferred expectation of what food substance is expected to be cooked.

The computing device 206 can be configured to detect trigger events dictated by or specified in one or more heating sequences of one or more food cooking recipes. For example, the logic of the heating sequence can include an instruction to adjust a spectral power distribution of the wireless energy emitted from the tunable heating element in response to the computing device 206 detecting a particular trigger event. After the heating sequence is initiated, the computing device 206 starts to monitor for the detection of the trigger event. In response to detecting the trigger event, the computing device 206 can configure the heating system to adjust the spectral power distribution of the emitted wireless energy from the tunable heating element. In some embodiments, the heating sequence includes an instruction to simultaneously adjust, based on a trigger event detectable by the computing device 206, a plurality of spectral power distributions of wireless waves emitted respectively from the multiple heating elements 218 in the heating system 216. In some cases, the instruction can specify a target spectral power distribution as corresponding to one of the trigger event. In some cases, the instruction can specify a target object category (e.g., defined by foodstuff shape, foodstuff size, foodstuff material, or any combination thereof) associated with the target spectral power distribution as corresponding to one of the trigger event.

In some embodiments, the persistent memory 214 stores a logic function or a database (e.g., a lookup table) that associates target object categories (e.g., defined by material, size, shape, etc.) respectively with wavelength-specific configurations (e.g., each wavelength-specific configuration associated with a target spectral power distribution and/or how to adjust the spectral power distribution to the target spectral power distribution). Instructions in a heating sequence can reference the logic function or the database to identify a wavelength-specific configuration associated with a target spectral power distribution. A wavelength-specific configuration can be associated with a set of one or more parameters that configure the computing device 206 to send a control signal to the heating system 216. The control signal can correspond to characteristics indicative of a target spectral power distribution of waves emitted from the tunable heating element.

A wavelength-specific configuration can be associated with one or more absorbent wavelengths, transmissive wavelengths, or reflective wavelengths of one or more materials in or that are part of the cooking chamber. For example, the materials can include food, glass, metal, air, or any combination thereof. The computing device 206 can be configured to determine that a target foodstuff category (e.g., user-specified, recipe-specified, or image-sensor-identified) or a target intermediary cooking medium is in a target object category and drive the tunable heating element according to the wavelength-specific configuration associated with the target object category according to the database in the persistent memory 214. In some embodiments, the absorptivity characteristic of the target object category allows for multiple wavelength-specific configurations. In those embodiments, a single wavelength-specific configuration can be selected by the computing device 206 to optimize for available power density (e.g., cooking speed) based on the absorptivity band(s) of the target object category.

In some embodiments, aside from adjusting the spectral power distribution, the heating sequence can also include instructions to adjust the intensity, duration, pulse pattern, or any combination thereof, of the wireless energy emitted from the tunable heating element. Execution of the instruction can be dynamic or sequentially timed. That is, the trigger event can be a time-based event, a modeled or simulated event, an event triggered by neural network, a user indicated event, or a sensor data indicated event.

In various embodiments, the spectral power distribution of waves emitted from a tunable heating element is adjusted by modulating power provided to the tunable heating element to tune the temperature of the tunable heating element to a particular range. In some embodiments, the power supply 202 is adapted to supply electrical power to the tunable heating element according to instructions from the computing device 206. The power supply 202 can draw power from an AC wall outlet. For example, the power supply 202 can include an AC power plug adapted to connect with the wall outlet. In some embodiments, the power supply 202 provides pulse modulated or phase-fired control of electrical power to the tunable heating element. For example, the pulse modulated electrical power can be modulated DC power or rectified half-cycle AC power.

Figure 8:
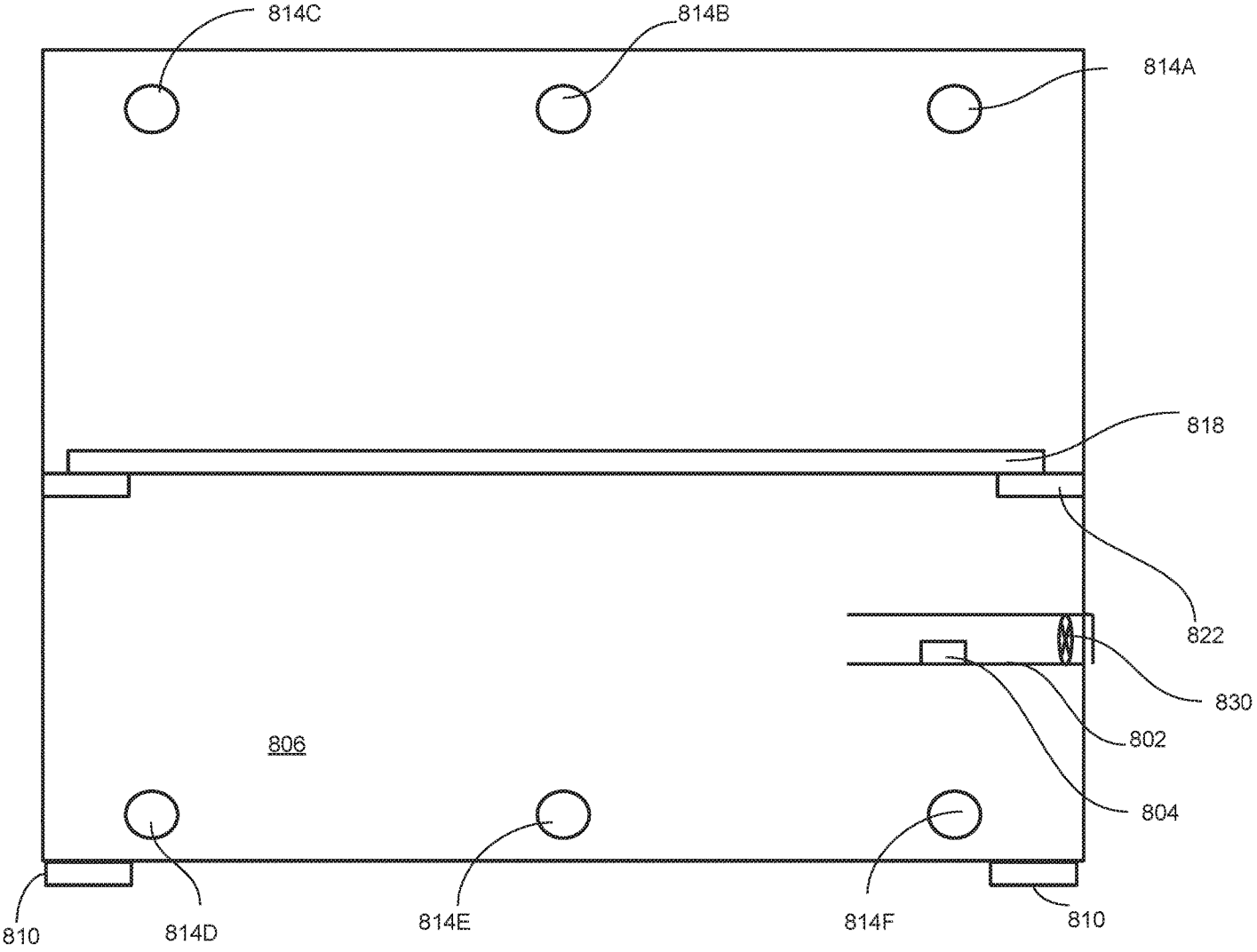
FIG. 8 is another example of a cross-sectional view of a cooking instrument with an air exhaust and a particulates sensor, in accordance with various embodiments.

In some cases, the computing device 206 can adjust the spectral power distribution of the tunable heating element by adjusting a duration that the power supply 202 is supplying power to the tunable heating element. For example, the persistent memory 214 can store a driver parameter. The driver parameter can be associated with a target spectral power distribution or at least a characteristic thereof. The driver parameter can be correlated with a variation of the spectral power distribution as a function of time that the tunable heating element is continuous turned on without a substantial pause (e.g., duration of what constitute "substantial pause" can be stored as a parameter as well). The computing device 206 can adjust the duration based on the driver parameter and the known time that the tunable heating element has been continuously turned on. Alternatively, the driver parameter can be correlated with variation to the spectral power distribution as a function of an operational core temperature of the tunable heating element. The computing device 206 can adjust the duration based on the driver parameter and the known operational core temperature of the tunable heating element. The function represented by the driver parameter advantageously enables the computing device 206 to tune the spectral power distribution emitted from a single heating element. The applied power duty cycle in combination with known physical characteristics can be used to estimate operating core temperature of the tunable heating element because temperature increases over time whenever a tunable heating element is connected to electrical power up until equilibrium temperature is reached. Equilibrium is when temperature dissipation is substantially equal and opposite to temperature increase. This effect is illustrated in the graph of FIG. 8.

In some embodiments, the power supply 202 includes a power control mechanism capable of switching power on or off to the tunable heating element. In some embodiments, the power control mechanism is a binary power switch. In some embodiments, the power control mechanism provides more than two states of power connections, such as an off state, a maximum power state, and one or more reduced power states. In these embodiments, the computing device 206 is configured to adjust the spectral power distribution of the tunable heating element to a target spectral power distribution by pulse modulating using the power control mechanism (e.g., according to a control signal from the control system to the power control mechanism). For example, the computing device 206 can pulse modulate the power control mechanism until a target core temperature of the tunable heating element is reached. The persistent memory 214 can store an association between the target spectral power distribution and the target core temperature such that the computing device 206 can determine that they correspond to each other during operation of the heating system 216. The persistent memory 214 can store an association between a pulse modulation configuration (e.g., pulse frequency, pulse width/duty cycle, pulse intensity, or any combination thereof) and a target spectral power distribution.

The computing device 206 can be configured to slow (e.g., decrease in frequency) the pulse modulating of the power control mechanism when an estimated operational temperature of the tunable heating element is above a threshold temperature, when the power control mechanism has been in a particular state for more than a threshold duration, and/or when the power control mechanism has been in a particular state for more than a threshold amount in a preset duration. The particular state can be either an "on" state or an "off state". The slowing of the pulse modulation can include stopping the pulse modulation. Threshold amount can be measured as a fraction or a percentage within preset duration that the power control mechanism is in the particular state. Similar to the mechanism of slowing, the computing device 206 can be configured to speed up (e.g., decrease in frequency) the pulse modulating of the power control mechanism when an estimated operational temperature of the tunable heating element is below a threshold temperature, when the power control mechanism has been in a particular state for less than a threshold duration, and/or when the power control mechanism has been in a particular state for less than a threshold amount in a preset duration.

Particulate Detection

Several embodiments pertain to a cooking instrument (e.g., the cooking instrument 200) capable of utilizing air particulates detection to determine the stage of a heating process and use that as feedback to the user or the computing device 206 to dynamically update or configure such heating process. The cooking instrument can execute the heating process by controlling a heating system (e.g., the heating system 216). Such stage of the heating process can be indicative of the state of the food, the state of the air inside the cooking chamber, the state of a cooking platform in the cooking chamber, a state of a heating system, or any combination thereof.

In some embodiments, the cooking instrument includes an air exhaust 268. The air exhaust 268 can be a passive structure that funnels air out of the cooking chamber or an active structure that actively pulls or pushes air through a particular path.

In some embodiments, the cooking instrument includes a particulates sensor 270. The particulates sensor 270 can be positioned such that air passing toward, through, or out of the air exhaust 268 flows over the particulates sensor 270. In some embodiments, the particulates sensor 270 is positioned in the cooking chamber. In some embodiments, the particulates sensor 270 is positioned outside of the cooking chamber adjacent to the air exhaust 268. The particulates sensor 270 can be adapted to detect particles given off by food under heat. In embodiments of the cooking instrument 200 having the camera 222, the particulates sensor 270 can be positioned, shaped, or built with a material such that the particulates sensor 270 is substantially invisible to the camera 222 when the camera 222 is focused on imaging the food in the cooking chamber or on a cooking platform.

Figure 7:
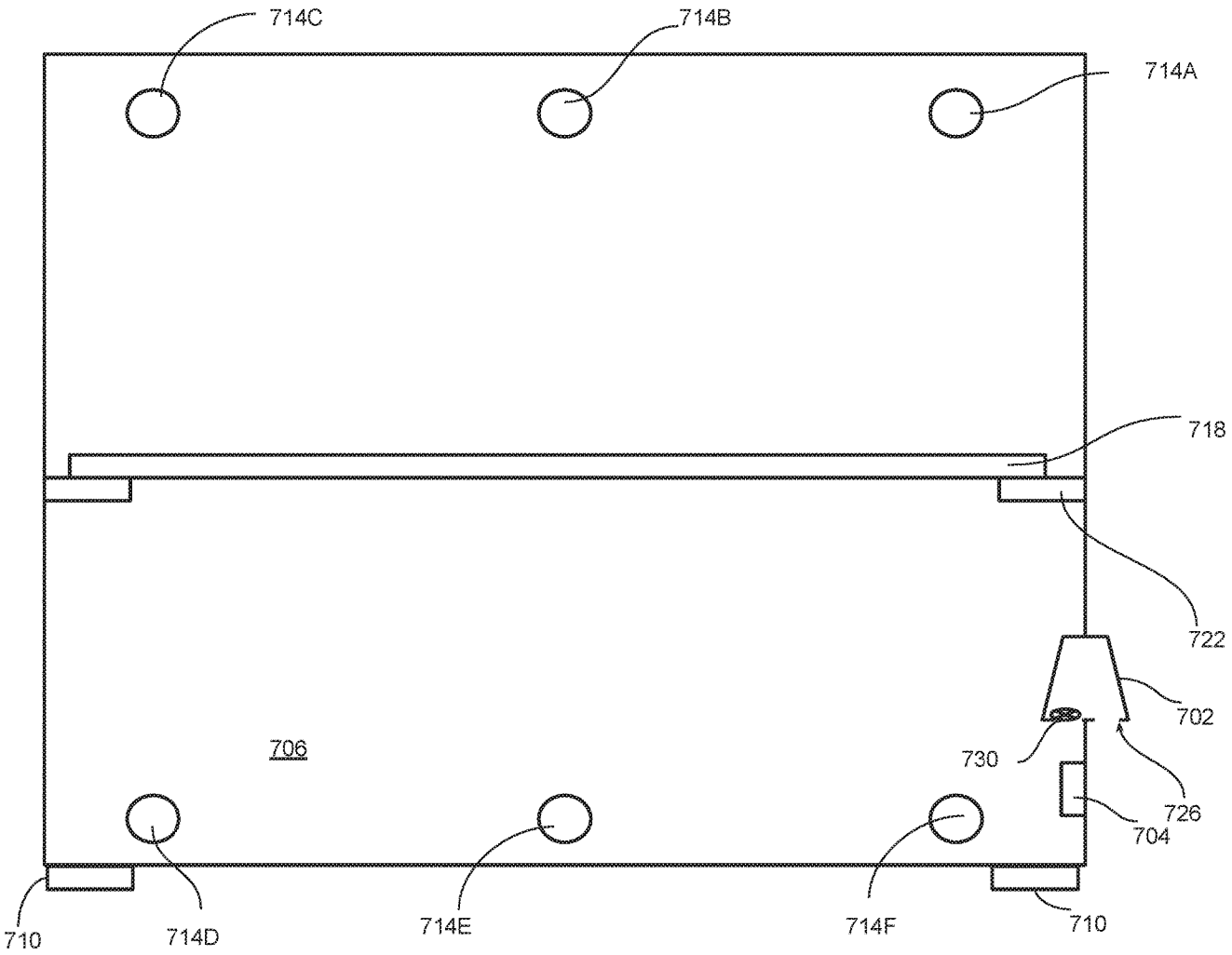
FIG. 7 is an example of a cross-sectional view of a cooking instrument with an air exhaust and a particulates sensor, in accordance with various embodiments

FIG. 7 is an example of a cross-sectional view of a cooking instrument 700 with an air exhaust 702 (e.g., the air exhaust 268) and a particulates sensor 704, in accordance with various embodiments. The particulates sensor 704 can be the particulates sensor 270 of FIG. 2. The cooking instrument 700 can be the cooking instrument 500 of FIG. 5A. That is, in some embodiments, the cooking instrument 500 includes the air exhaust 702, the particulates sensor 704, and other components illustrated in FIG. 7. The particulates sensor 704 can be positioned along the air flow path through the air exhaust 702.

The air exhaust 702 can define an opening in a cooking chamber 706 (e.g., the cooking chamber 102). The cooking instrument 700 can be propped up by one or more leg stands 710. In some embodiments (not illustrated), the air exhaust 702 can open up into the space propped up by the leg stands 710 (e.g., bottom of the cooking chamber 706). The cooking instrument 700 can include a heating system (e.g., the heating system 216) that includes heating elements (e.g., heating element 714A-F, collectively as the "heating elements 714"). When the heating elements 714 are operational and generating electromagnetic waves (e.g., visible, near-visible, and/or non-visible light), a food target in the cooking chamber 706 can undergo a transformation. Such transformation may release particles from the food target into the air in the cooking chamber 706. In some embodiments, the cooking instrument 700 includes a cooking platform 718 (e.g., the cooking platform 110) that supports the food target. The cooking platform 718 can be held by platform supports 722 (e.g., rails or pegs).

Air within the cooking chamber 706 (including the released particles) can move toward the air exhaust 702. In some embodiments, the air exhaust 702 includes or is mechanically coupled to a flow control structure 726 within the cooking chamber 706. The flow control structure 726 can be adapted to substantially limit velocity of the air passing toward or through the air exhaust 702. In some embodiments, the cooking instrument 700 includes an air movement device 730 that facilitates the air to move through the air exhaust 702. In the illustrated figure, the air movement device 730 is positioned at one opened end of the air exhaust 702. However, in other embodiments, the air movement device 730 can be positioned within the air exhaust 702, at the opposing opened end of the air exhaust 702, outside of the cooking chamber 706, or inside the cooking chamber 706. In some embodiments, the cooking instrument 700 includes multiple air movement devices positioned in any of the aforementioned locations. In the illustrated figure, the particulates sensor 704 is positioned in front of one opened end of the air exhaust 702. However, in other embodiments, the particulates sensor 704 can be positioned within the air exhaust 702, at the opposing opened end of the air exhaust 702, outside of the cooking chamber 706, or inside the cooking chamber 706. In some embodiments, the cooking instrument 700 includes multiple particulates sensors positioned in any of the aforementioned locations.

In some embodiments, the particulates sensor 704 is in the cooking chamber 706. The particulates sensor 704 can be within the air exhaust 702. In some embodiments, the particulates sensor 704 is outside of the cooking chamber 706. The particulates sensor 704 can be outside the cooking chamber 706 measuring visibility of smoke from the air exhaust 702 (e.g., an opening in the cooking chamber 706).

FIG. 8 is another example of a cross-sectional view of a cooking instrument 800 with an air exhaust 802 (e.g., the air exhaust 268) and a particulates sensor 804 (e.g., the particulates sensor 270), in accordance with various embodiments. The cooking instrument 800 can be the cooking instrument 500 of FIG. 5A. That is, in some embodiments, the cooking instrument 800 includes the air exhaust 802, the particulates sensor 804, and other components illustrated in FIG. 8. The particulates sensor 804 can be positioned along the air flow path through the air exhaust 802. In the embodiments illustrated in FIG. 8, the particulates sensor 804 is positioned inside the air exhaust 802.

The air exhaust 802 can define an opening in a cooking chamber 806 (e.g., the cooking chamber 102). The air exhaust 802 can be shaped as a pipe. The cooking instrument 800 can be propped up by one or more leg stands 810. In some embodiments (not illustrated), the air exhaust 802 can open up into the space propped up by the leg stands 810 (e.g., bottom of the cooking chamber 806). The cooking instrument 800 can include a heating system (e.g., the heating system 216) that includes heating elements (e.g., heating element 814A-F, collectively as the "heating elements 814"). When the heating elements 814 are operational and generating electromagnetic waves (e.g., visible, near-visible, and/or non-visible light), a food target in the cooking chamber 806 can undergo a transformation. Such transformation may release particles from the food target into the air in the cooking chamber 806. In some embodiments, the cooking instrument 800 includes a cooking platform 818 (e.g., the cooking platform 110) that supports the food target. The cooking platform 818 can be held by platform supports 822 (e.g., rails or pegs).

Air within the cooking chamber 806 (including the released particles) can move toward the air exhaust 802. In some embodiments, the cooking instrument 800 includes an air movement device 830 that facilitates the air to move through the air exhaust 802. In the illustrated figure, the air movement device 830 is positioned at one opened end of the air exhaust 802. However, in other embodiments, the air movement device 830 can be positioned within the air exhaust 802, at the opposing opened end of the air exhaust 802, outside of the cooking chamber 806, or inside the cooking chamber 806. In some embodiments, the cooking instrument 800 includes multiple air movement devices positioned in any of the aforementioned locations. In some embodiments (not illustrated), the particulates sensor 804 can be positioned at one opened end of the air exhaust 802, outside of the cooking chamber 806, or inside the cooking chamber 806. In some embodiments, the cooking instrument 800 includes multiple particulates sensors positioned in any of the aforementioned locations.

Figure 9:
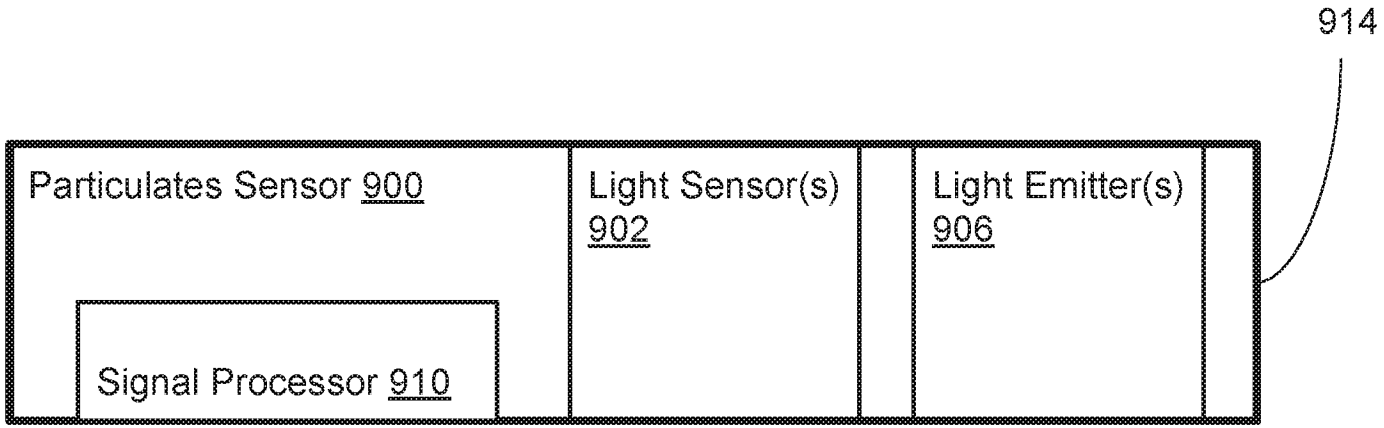
FIG. 9 is an example of a cross-sectional view of a particulates sensor for use in or with a cooking instrument, in accordance with various embodiments.

FIG. 9 is an example of a cross-sectional view of a particulates sensor 900 for use in or with a cooking instrument (e.g., the cooking instrument 200), in accordance with various embodiments. The particulates sensor 900 includes one or more light sensors 902 and one or more light emitters 906. In some embodiments, the one or more light sensors 902 are composed of an array of light sensor units. In some embodiments, the one or more light emitters 906 are composed of an array of light emitter units. In some embodiments, the one or more light sensors 902 is one or more photodiodes capable of sensing scattering of nearby light. Particularly, the one or more light sensors 902 can be configured to detect scattering of light in a preconfigured spectrum corresponding to the spectrum of the one or more light emitters 906.

The particulates sensor 900 can optionally include a signal processor 910. For example, the signal processor 910 can convert the readings of the one or more light sensors 902 into a digitized and quantified format. In some embodiments, the one or more light emitters 906 can emit multiple wavelengths or ranges of wavelengths of light. The one or more light sensors 902 can be adapted to detect and discriminate between such wavelengths or ranges of wavelengths. In those embodiments, the signal processor 910 can generate one or more output channels for the particulates sensor 900, each output channel corresponding to a particular particle type and a particular wavelength or range of wavelengths. The signal processor 910 or an external computing device can thus differentiate between multiple particle types based on known varying reflectance properties (e.g., according to pre-configured values) corresponding to different light wavelengths emitted from the one or more light emitters 906.

Components of the particulates sensor 900 can be housed within a housing 914. The particulates sensor 900 can detect in-air particles based on measuring light scattering from a volume of air over the one or more light sensors 902 when the one or more light emitters 906 are emitting one or more wavelengths of light toward the volume of air. In some cases, the detection range of the one or more light sensors 902 is at least a 2 inch radius, enabling the one or more light sensors 902 to detect scattering from not too large of an area such that the smoke would pass through and yet not too small of an area such that smoke is missed by the light emitters 906 and the light sensors 902. In some embodiments, the one or more light sensors 902 can be one or more photodiodes. In some examples, the one or more light emitters 906 are adapted to emit in or substantially in the visible spectrum, the near-visible spectrum (e.g., including near infrared spectrum), the non-visible spectrum (e.g., including the infrared spectrum), or any combination thereof. In various embodiments, the one or more light sensors 902 are adapted to sense light in at least in the spectrum of light emitted by the one or more light emitters 906.

In some embodiments, the particulates sensor 900 is embodied as an integrated chip, such as a pulse oximetry sensor chip. That is, the one or more light sensors 902, the one or more light emitters 906, and the signal processor 910 can be integrated together or at least packaged together. In some embodiments, the one or more light emitters 906 include a first emitter unit and a second emitter unit. The first emitter unit can produce light (i.e., electromagnetic waves) in a first spectrum and the second emitter unit can produce light in a second spectrum. For example, the first spectrum can be the color blue and the second spectrum can correspond to infrared. The one or more light sensors 902 can be adapted to differentiate between the first spectrum and the second spectrum. For example, the one or more light sensors 902 can include a first light sensor unit corresponding to the first spectrum and a second light sensor unit corresponding to the second spectrum. In these embodiments, the presence of the second emitter unit enables the one or more light sensors 902 to obtain an extra channel of information. Utilizing this extra channel of information, the computing device 206 can detect quantities of different sizes of particles.

In some embodiments, the signal processor 910 can provide the sensor readings from the one or more light sensors 902 to the computing device 206. In some embodiments, the computing device 206 can then compute an absorbance level of light emitted from the one or more light emitters 906 based on the sensor readings and a known or reported (e.g., from the particulates sensor 900 to the computing device 206) emission power associated with the one or more light emitters. In some embodiments, the signal processor 910 can compute the absorbance level and then transmit the computed absorbance level to the computing device 206.

In some embodiments, the computing device 206 is configured to determine the stage of the heating process by at least determining a ratio of absorbance levels between different spectrums of light, such as the first spectrum and the second spectrum described above. The computing device 206 can use the absorbance ratio to identify different types and corresponding amount of smoke or other type of particles.

In some embodiments, the computing device 206 (e.g., a controller) of the cooking instrument 200 is configured to execute a heating process and determine a stage of the heating process based on sensor data from the particulates sensor 270. The computing device 206 can control the heating system 216 dynamically according to the heating process and the determined stage. For example, the computing device 206 can determine whether the determined stage satisfies or fails a condition associated with a heating configuration in the heating process. The condition can be a condition precedent or a condition subsequent to the associated heating configuration. In one example, the computing device 206 is configured to turn off or reduce power to the heating system 216 based on the determined stage to prevent overcooking or burning. In another example, the computing device 206 is configured to determine the stage of the heating process by at least determining a thermal state of a target food in the cooking chamber. In yet another example, the computing device 206 is configured to determine the stage of the heating process by at least determining a thermal state of a cooking platform (e.g., the cooking platform 110) within a cooking chamber (e.g., the cooking chamber 102). In some embodiments, the computing device 206 can utilize that temperature reading from the cooking platform temperature sensor 264 together with the sensor reading from the particulates sensor 270 to determine the stage of the heating process. In some embodiments where the cooking platform temperature sensor 264 is absent or otherwise not turned on, the computing device 206 can utilize the sensor readings from the particulates sensor 270 to estimate the thermal state of the cooking platform.

In some embodiments, the computing device 206 is configured to determine the stage of the heating process by at least determining quantity of a particular type of particles in the air passing over the particulates sensor 270. For example, the particular type of particles can correspond to a size, a range of sizes, or a set of ranges of sizes of particles in the air (e.g., air passing over the particulates sensor 270).

In some embodiments, the computing device 206 can measure temperature data utilizing the chamber thermometer 250, the temperature probe 254, the cooking platform temperature sensor 264, the accessory sensor interface 266, or any combination thereof, and determine the quantity of a particular type of particles based on the sensor readings from the particulates sensor 270 and the measured temperature data. Likewise, the computing device 206 can determine the stage of the heating process based on the determined quantity, the temperature data, the sensor readings from the particulates sensor 270, or any combination thereof.

In some embodiments, the environment sensors 246 includes a humidity sensor 276 adapted to measure humidity data (e.g., released from or in the cooking chamber). The computing device 206 can be configured to determine the quantity of the particular type of particles based on the sensor readings from the particulates sensor 270 and the humidity data. The computing device 206 can also be configured to determine the stage of the heating process based on the determined quantity, the humidity data, the sensor data, or any combination thereof. In some cases, the computing device 206 can be configured to turn off or reduce power to the heating system 216 based on the determined stage to prevent overcooking or burning. For example, humidity may be used to aid in differentiation between steam and smoke, to identify cooking stages and surface temperatures of the target food corresponding to water vaporization.

In some embodiments, the computing device 206 is configured to determine the stage of the heating process by at least determining a size distribution of particles in the air (e.g., the air passing over the particulates sensor 270). In some embodiments, the computing device 206 is configured to determine the stage of the heating process by at least computing a particle size quantity ratio. The particle size quantity ratio is a ratio between a first quantity of a first particle size range and a second quantity of a second particle size range. For example, the computing device 206 can be configured to determine the stage of the heating process by at least identifying a food transformation event based on the computed particle size quantity ratio. Such food transformation event can include burning of a particular material, searing on a particular surface, phase transformation of a particular material, or any combination thereof. In another example, the computing device 206 can be configured to determine, based on the particle size amount, particle size quantity ratio, humidity, temperatures (e.g., by various temperature sensors), or any combination thereof, that there is fire or will be fire in the cooking chamber. When the computing device 206 determine that there is fire or will be fire, the computing device 206 can send or generate an alert to notify the user of the cooking instrument 200 to put out the fire, confirm automated remedial actions, manually take remedial actions, or any combination thereof.

In some embodiments, the computing device 206 is configured to assign two or more zones in the cooking chamber. For example, the assignment can be based on a stored configuration in the operational memory 210 or the persistent memory 214. The computing device 206 can execute a heating process that includes focusing heat from the heating system 216 on each of the zones until a threshold quantity of the particle type is reached. The computing device 206 can determine the quantity of a particular particle type based on any of the techniques described herein. The quantity of a particular type of particles reaching a threshold may indicate one or more chemical changes representative of a type of food being "done", a quantifiable measure indicative of good taste. Thus, by focusing heating to each zone and sustaining the heat till a threshold quantify of a type of particles is reached enables the cooking instrument 200 to gain an ability to measure the cooking process in each zone, even with a sensor (e.g., the particulates sensor 900) that cannot on its own discriminate between zones.

In some embodiments, the operational memory 210 and/or the persistent memory 214 stores an airspeed configuration corresponding to an estimate of the air speed of particulates when exiting the air exhaust 268. The computing device 206 can be configured to compute the average particle size in the air (e.g., air exiting the air exhaust 268) based on the sensor data of the particulates sensor 270 and the airspeed configuration. In some embodiments, the operational memory 210 and/or the persistent memory 214 stores an environment profile, such as the user's room size, ventilation, and/or smoke detector placement. In some embodiments, the operational memory 210 and/or the persistent memory 214 stores an alert configuration. In these embodiments, the computing device 206 is configured to generate an alert based on cumulative processing of the sensor data of the particulates sensor 270 over time, the alert configuration, the environment profile, or any combination thereof. The computing device 206 can calculate if smoke is being generated in quantities that is likely to set-off a smoke detector. The computing device 206 can have intelligence/logic that can calculate the smoke exhausted over time and its correlation to smoke detector limits.

In some embodiments, the computing device 206 is configured to detect smoke based on the sensor data from the particulates sensor 270. The computing device 206 can determine whether the smoke is detected within a predetermined time after turning on at least one of the heating elements 218, and identify the turned-on heating element as dirty in response to determining the smoke is detected within the predetermined time. After identifying a particular heating element as being dirty, the computing device 206 can issue instruction to the user on how to clean the particular heating element or prompt the user to run a self-cleaning routine (executable via the computing device 206 and the heating system 216). The self-cleaning routine can include powering the dirty heating element or one or more nearby heating elements to burn off the dirt. The computing device 206 can further issue an alert to warn the user to expect some smoke during the self-cleaning routine, which alert can terminate when the dirt is determined to be burnt away (e.g., using the method described herein).

In some embodiments, the computing device 206 is configured to compute a position of burning substance based on the sensor data from the particulates sensor 270 and a timestamp associated with an instruction to the heating system 216. The use of the timestamp advantageously enables the computing device 206 to use the particle quantity data and heating element turn-on data to estimate how far away burning particles are from the heating element that are turned-on. The computing device 206 can use the position of the burning substance to alert the user or inform the heating process to execute one or more safety routines to prevent harm or damage.

Figure 3:
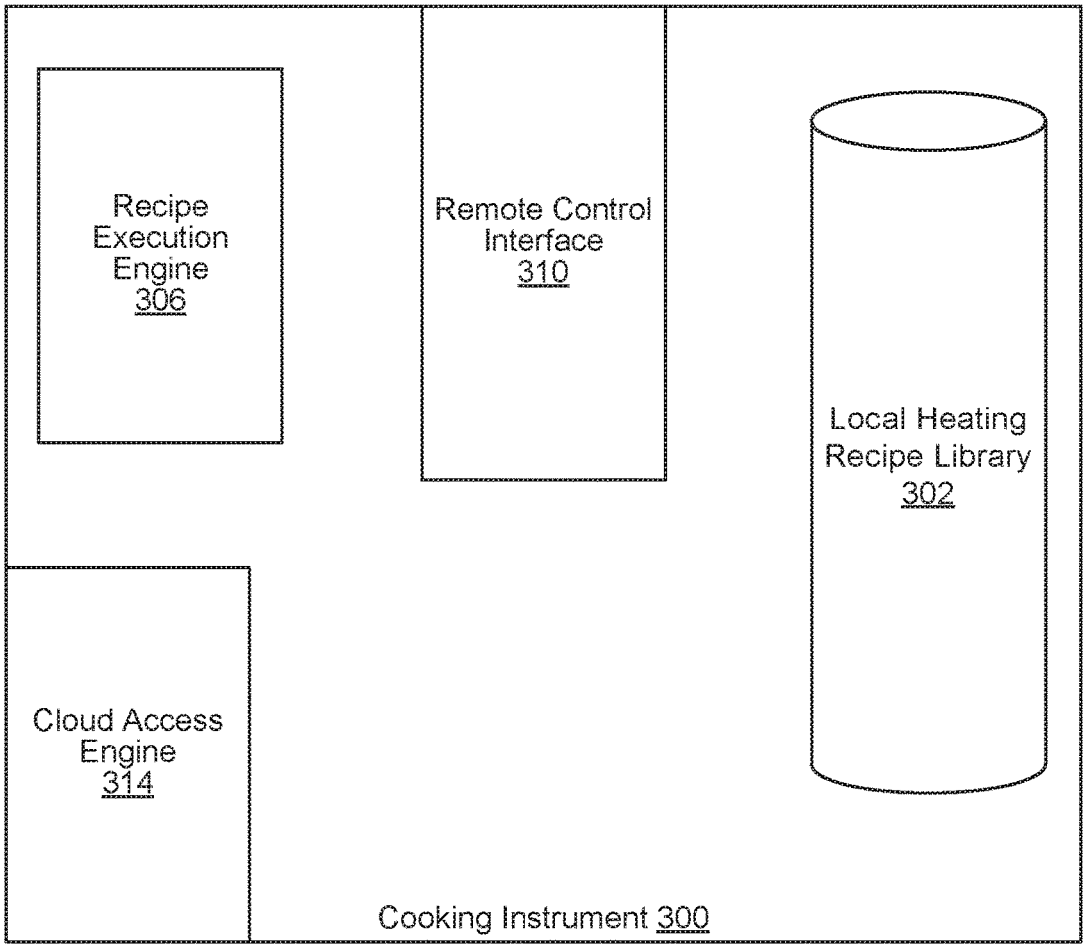
FIG. 3 is a block diagram illustrating functional components of a cooking instrument, in accordance with various embodiments.

FIG. 3 is a block diagram illustrating functional components of a cooking instrument 300 (e.g., the cooking instrument 100 and/or the cooking instrument 200), in accordance with various embodiments. For example, the functional components can run on the computing device 206 or one or more specialized circuits. For example, the cooking instrument 300 can implement at least a cooking recipe library 302, a recipe execution engine 306, a remote control interface 310, a cloud access engine 314, or any combination thereof. The cooking recipe library 302 stores one or more cooking recipes, each cooking recipe including one or more heating sequences respectively for one or more portions of food. The recipe execution engine 306 interprets the executable instructions from the cooking recipes and its heating sequences. The remote control interface 310 enables the functional components of the cooking instrument 300 to be controlled by an external user device (not shown). The remote control interface 310 can enable the external user device to configure the functional components of the cooking instrument 300 or to request information from the external user device. For example, the remote control interface 310 can connect with the external user device via the network interface 226. The cloud access engine 314 enables the cooking instrument 300 to communicate with a backend server system (not shown) to configure the functional components of the cooking instrument 300 or to request information from the backend server system.

In some examples, the recipe execution engine 306 can load and interpret a set of instructions to implement a cooking recipe, including executing a heating sequence (e.g., a dynamic segments, static segments, or any combination thereof). For example, the recipe execution engine 306 can analyze an image from a camera (e.g., the camera 222) to determine whether a door (e.g., the door 106) is open. For example, the image from the camera may be illuminated by a specific color of a specific light source (e.g., the light source 242) when facing toward an interior of the cooking instrument 300. In some examples, the recipe execution engine 306 is configured to analyze an image from the camera to determine whether a machine-readable optical label is within the image. For example, the recipe execution engine 306 can be configured to select a cooking recipe from the cooking recipe library 302 based on the machine-readable optical label. In this example, the remote control interface 310 is configured to send a message to an external user device to confirm the automatically selected cooking recipe. In some examples, the recipe execution engine 306 is configured to present the cooking recipe for confirmation on a local display and to receive the confirmation a local input component when the cooking recipe is displayed. In response to the selection of the cooking recipe, the recipe execution engine 306 can execute a heating sequence in accordance of the cooking recipe by controlling the heating elements. The heat adjustment algorithm is capable of dynamically controlling the heating elements 218 (e.g., adjusting output power, spectral power distribution, and/or peak wavelength(s)) in real-time in response to changing input variables (e.g., real-time sensor inputs, user inputs, external user device or backend server system provided parameters, or any combination thereof).

The remote control interface 310 can be used to interact with a user. For example, a user device (e.g., a computer or a mobile device) can connect to the remote control interface via the network interface 226. Via this connection, the user can configure the cooking instrument 300 in real-time. In one example, the user can select a cooking recipe via a user-device-side application running on the user device. The user-device-side application can communicate the remote control interface 310 to cause the cooking instrument 300 to execute the selected cooking recipe. The cloud access engine 314 can enable the cooking instrument 300 to access a cloud service to facilitate execution of a cooking recipe and/or update the cooking recipes in the cooking recipe library 302.

Components (e.g., physical or functional) associated with the cooking instrument (e.g., the cooking instrument 100, the cooking instrument 200, and/or the cooking instrument 300) can be implemented as devices, modules, circuitry, firmware, software, or other functional instructions. For example, the functional components can be implemented in the form of special-purpose circuitry, in the form of one or more appropriately programmed processors, a single board chip, a field programmable gate array, a network-capable computing device, a virtual machine, a cloud computing environment, or any combination thereof. For example, the functional components described can be implemented as instructions on a tangible storage memory capable of being executed by a processor or other integrated circuit chip. The tangible storage memory may be volatile or non-volatile memory. In some embodiments, the volatile memory may be considered "non-transitory" in the sense that it is not a transitory signal. Memory space and storages described in the figures can be implemented with the tangible storage memory as well, including volatile or non-volatile memory.

Each of the components may operate individually and independently of other components. Some or all of the components may be executed on the same host device or on separate devices. The separate devices can be coupled through one or more communication channels (e.g., wireless or wired channel) to coordinate their operations. Some or all of the components may be combined as one component. A single component may be divided into sub-components, each sub-component performing separate method step or method steps of the single component.

In some embodiments, at least some of the components share access to a memory space. For example, one component may access data accessed by or transformed by another component. The components may be considered "coupled" to one another if they share a physical connection or a virtual connection, directly or indirectly, allowing data accessed or modified by one component to be accessed in another component. In some embodiments, at least some of the components can be upgraded or modified remotely (e.g., by reconfiguring executable instructions that implements a portion of the functional components). The systems, engines, or devices described herein may include additional, fewer, or different components for various applications.

Figure 4:
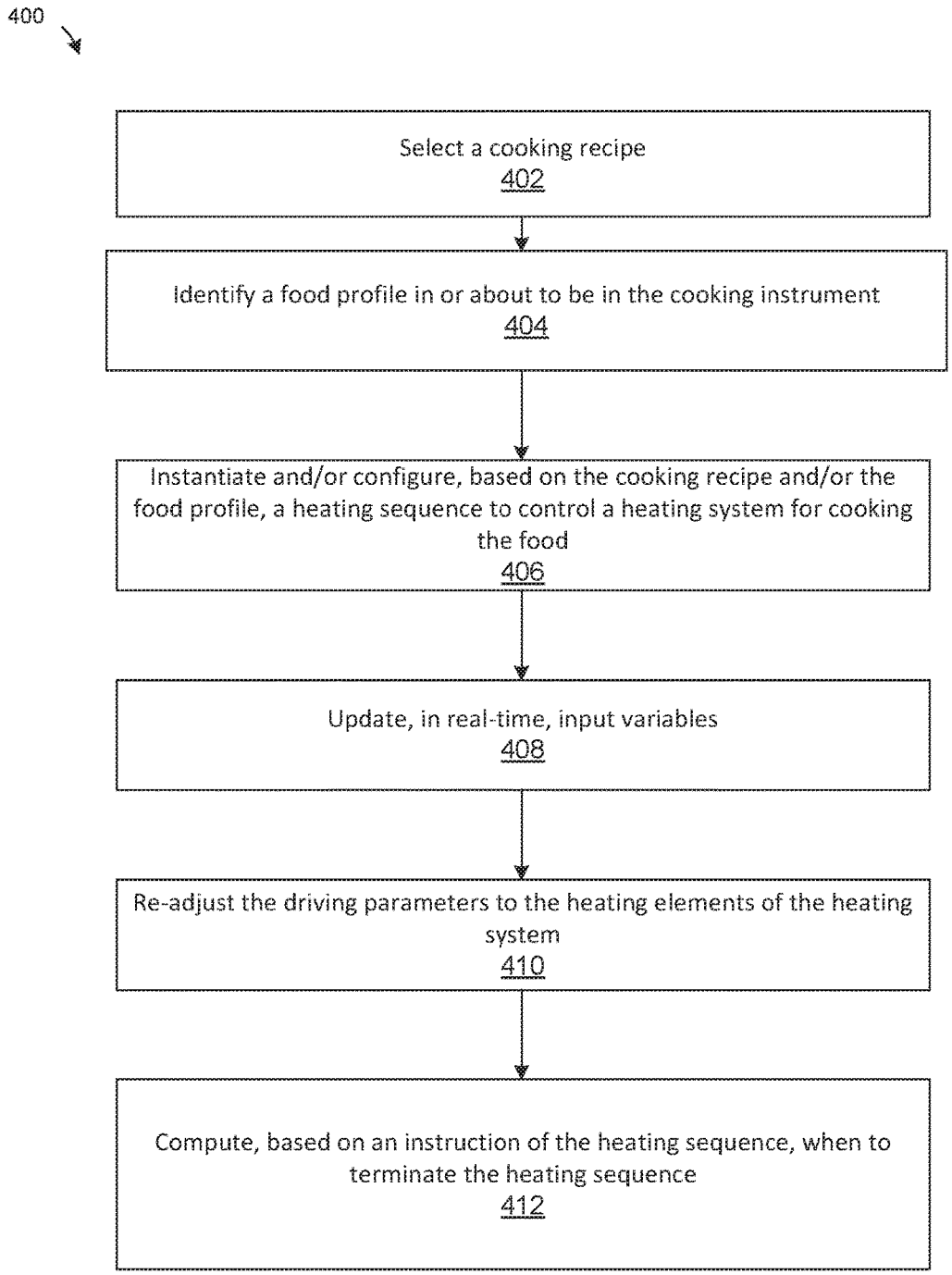
FIG. 4 is a flowchart illustrating a method of operating a cooking instrument to cook food, in accordance with various embodiments.

FIG. 4 is a flowchart illustrating a method 400 of operating the cooking instrument (e.g., the cooking instrument 100, the cooking instrument 200, and/or the cooking instrument 300) to cook food, in accordance with various embodiments. The method 400 can be controlled by a computing device (e.g., the computing device 206).

At step 402, the computing device can select a cooking recipe (e.g., from a local cooking recipe library stored in the local memory (e.g., the operational memory 210 and/or the persistent memory 214) of the computing device and/or the cooking instrument, in an external cooking recipe library implemented by a cloud service accessible through a network interface (e.g., the network interface 226), or in the memory of another external source connected to the computing device). Optionally, at step 404, the computing device can identify a food profile in or about to be in the cooking instrument. For example, the computing device can utilize a camera to identify the food profile (e.g., performing image recognition of the food or scanning a digital label attached to an outer package of the food). The food profile can identify the size of the food, the weight of the food, the shape of the food, the current temperature of the food, or any combination thereof.

At step 406, the computing device can instantiate and/or configure, based on the cooking recipe and/or the food profile, a heating sequence to control a heating system for cooking the food. The heating sequence can include one or more dynamic segments defined by a heat adjustment algorithm. The heat adjustment algorithm can specify how to adjust the driving parameters of one or more heating elements in the cooking instrument based on input variables that may change over time. Input variables can include time lapsed (e.g., time from when the heating elements are first driven and/or when the heating sequence first begins), temperature (e.g., detected by a temperature sensor in the cooking chamber or on the cooking platform) within the cooking instrument, user input (e.g., via an external device connected to the computing device or a control panel of the cooking instrument), temperature within the food (e.g., as reported by a temperature probe inserted into the food and communicatively coupled to the computing device), real-time or asynchronous image analysis of the food, real-time or asynchronous audio signal analysis from a microphone inside or outside of the cooking instrument, real-time or asynchronous environment sensor output analysis (e.g., analysis of the humidity and/or particulates data from the humidity sensor and/or the particulates sensor), other data received over a network, other data generated by a component of the cooking instrument, or any combination thereof. At step 408, the computing device can update, in real-time, the input variables and, at step 410, re-adjust the driving parameters to the heating elements of the heating system according to the heating sequence and/or the heat adjustment algorithm.

Part of the adjustment made by the heating sequence can include heat intensity, spectral power distribution and/or peak wavelength (e.g., for targeting different food or material within the cooking chamber), heat duration, target zone or cooking platform for heating, or any combination thereof. The computing device can configure the heating elements to apply different heating patterns to different zones (on the same cooking platform or different cooking platforms) in the cooking instrument. Each "zone" can be represented by an areas on a cooking platform or a portion of food resting on the cooking platform. The computing device can configure the heating elements to apply, simultaneously or sequentially, different heating patterns to different zones on the cooking platform by supplying different amount of power and/or emission spectral power distributions to different heating elements. The computing device can configure the heating elements to apply different heating patterns to different zones on the cooking platform by driving the heating elements of the heating system at varying peak wavelengths. The cooking instrument can include a perforated metallic sheet between the cooking platform and at least one of the heating elements. The computing device can configure the heating elements to apply different heating patterns to different zones on the cooking platform by using the perforated metallic sheet to spatially block portions of waves emitted by the at least one of the heating elements.

At step 412, the computing device can compute, based on at least an instruction in the heating sequence, when to terminate the heating sequence (e.g., when the cooking instrument stops supplying power to the heating elements). In some embodiments, the heating adjustment algorithm takes into account whether the food is expected to be extracted out of the cooking instrument substantially immediately after the termination of the heating process (e.g., a high-speed mode). For example, the heating adjustment algorithm can shorten the expected termination time if the user indicates that the food will remain in the cooking instrument a preset duration after the termination of the heating process (e.g., a low stress mode).

Figure 5A:
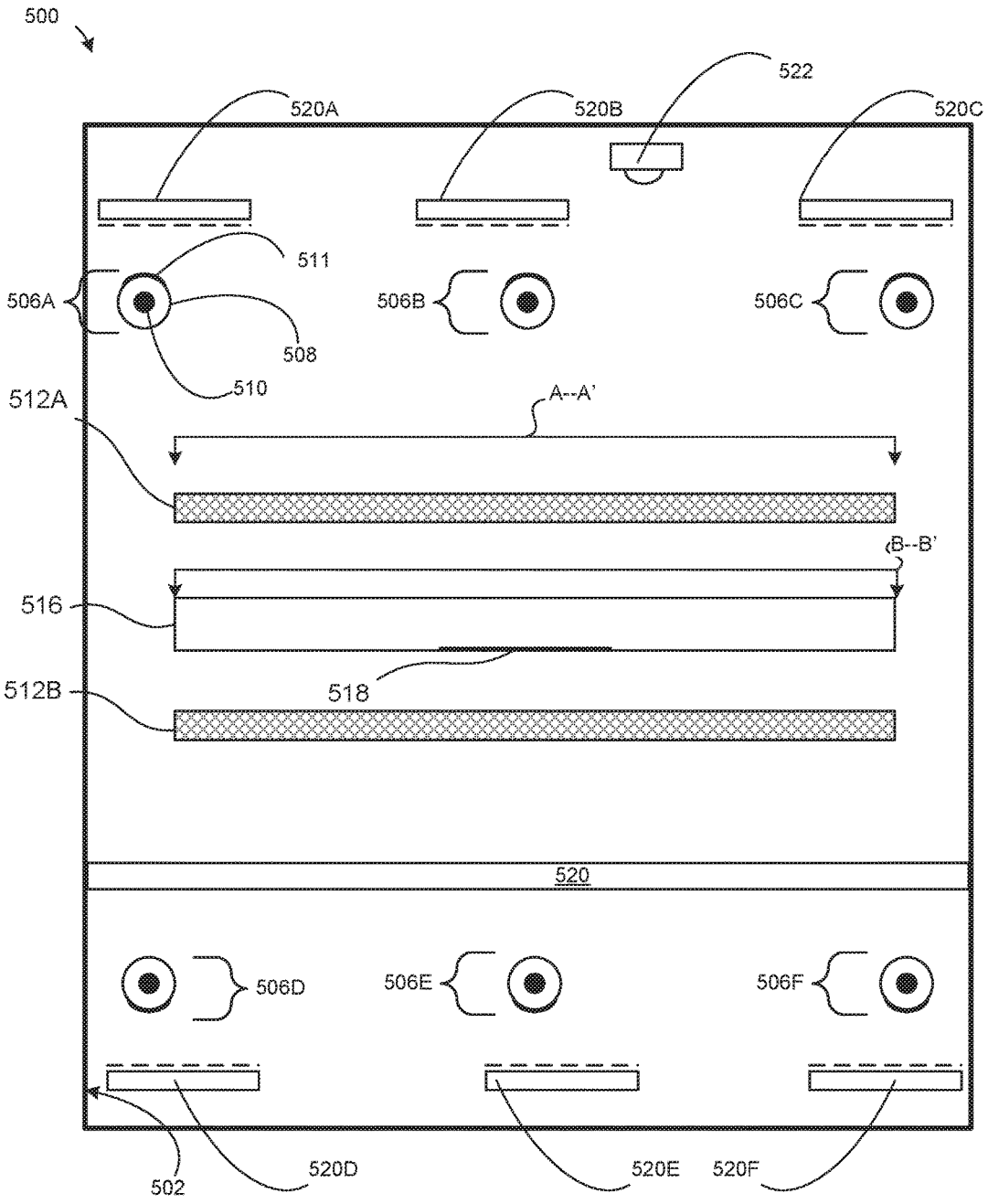
FIG. 5A is a cross-sectional front view of a first example of a cooking instrument, in accordance with various embodiments.

FIG. 5A is a cross-sectional front view of a first example of a cooking instrument 500 (e.g., the cooking instrument 100, the cooking instrument 200, and/or the cooking instrument 300), in accordance with various embodiments. The cooking instrument 500 includes a chamber 502 and a heating system (not labeled in FIG. 5A) with one or more filament assemblies 506 (e.g., a filament assembly 506A, a filament assembly 506B, a filament assembly 506C, a filament assembly 506D, a filament assembly 506E, a filament assembly 506F, etc., collectively as the "filament assemblies 506") at one or more locations in the chamber 502. The filament assemblies 506 can respectively be part of the heating elements of the cooking instrument 500. Each of the filament assemblies 506 can include a containment vessel 508 surrounding a filament 510.

The containment vessel 508 can be coated with reflective material to serve as a reflector 511. This way, the reflector 511 is prevented from being fouled by debris. The containment vessel 508 can be made of quartz. The reflective material can be gold or white ceramics, such as zirconium oxide, silicon oxide, etc. The filament assemblies 506 can be tungsten halogen assemblies. The reflective material can be coated on a portion of an outer surface of each of filament assemblies 506 or the containment vessel 508 that faces away from a cooking platform 516. In some embodiments, the reflector 511 is a separate component than each of the filament assemblies 506 and the containment vessel 508. For example, each of the reflector 511 can be positioned adjacent to each of the filament assemblies 506 away from the center of the cooking chamber. In some embodiments, the reflector 511 is placed close enough to each of the filament assemblies 506 such that during normal operations (e.g., approximately 450 Fahrenheit or above), debris is burnt off between the corresponding reflector 511 and each of the filament assemblies 506. In some embodiments, at least one of the filament assemblies 506 is between the reflector 511 and a glass covering. In some embodiments, a glass covering is between at least one of the filament assemblies 506 and the reflector 511.

In some embodiments, the containment vessel 508 does not need a reflector. In some embodiments, the reflector 511 can be external to the containment vessel 508. Anti-fouling can be achieved by choosing a distance between the reflector 511 (e.g., in the case that it is external to the containment vessel 508) and the containment vessel 508 such that undesirable materials are burnt off the reflector 511 and/or the containment vessel 508. In some embodiments, the reflector 511 and/or the containment vessel 508 can be shielded from debris directly using another (transparent) material. In some embodiments, the filament assemblies 506 each has an end cap made of ceramic substance. The filament 510 can be wounded to dramatically increase total length of filament without increasing the length of the filament assembly. The filament 510 can be wound uniformly or non-uniformly. Ends of the filament 510 can be sealed with molybdenum foil while maintaining electrical conductivity. The filament 510 can be wound with varying diameter or uniform diameter.

Figure 5B:
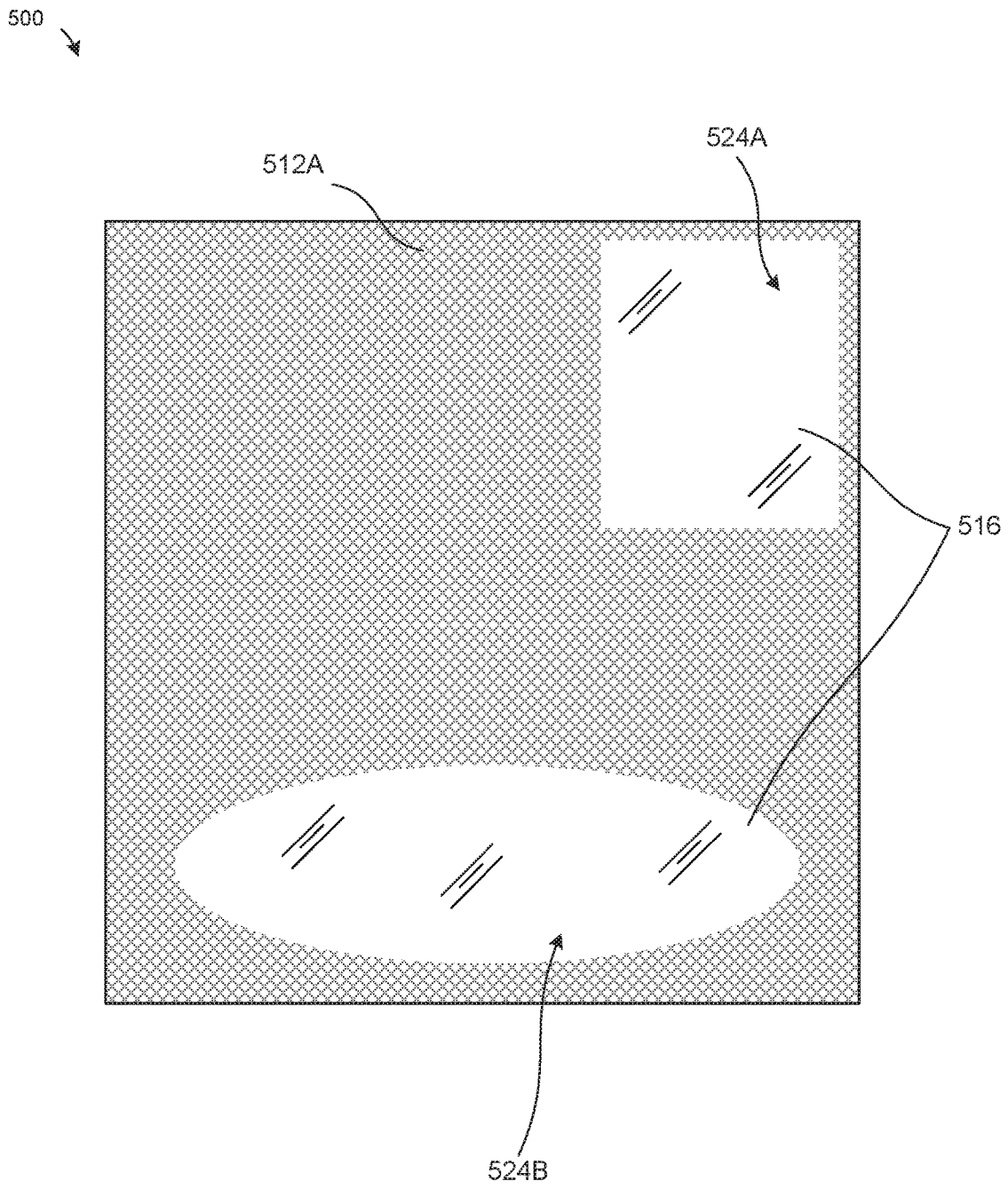
FIG. 5B is a cross-sectional top view of the cooking instrument of FIG. 5A along lines A-A', in accordance with various embodiments.
Figure 5C:
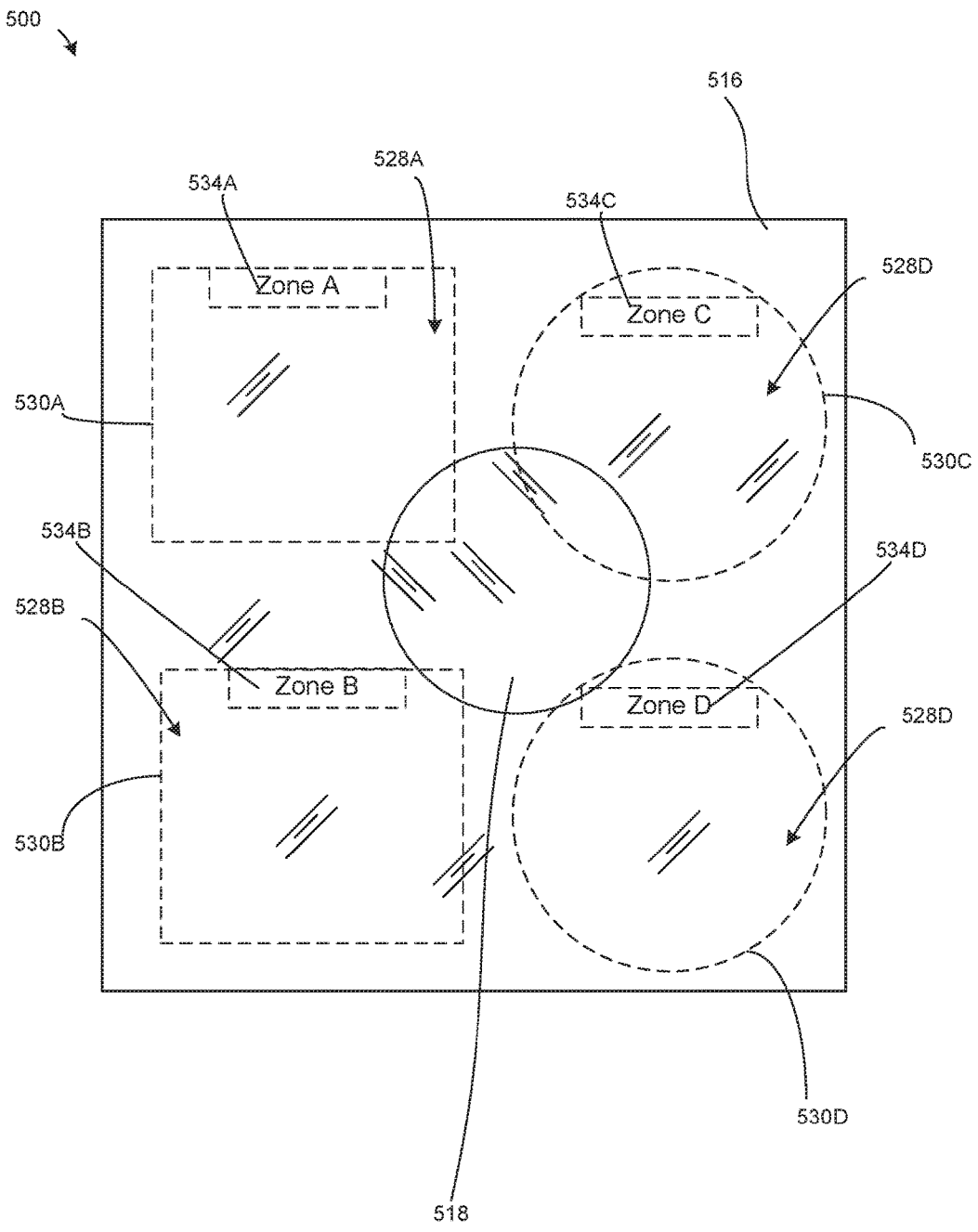
FIG. 5C is a cross-sectional top view of the cooking instrument of FIG. 5A along lines B-B', in accordance with various embodiments.
Figure 5D:
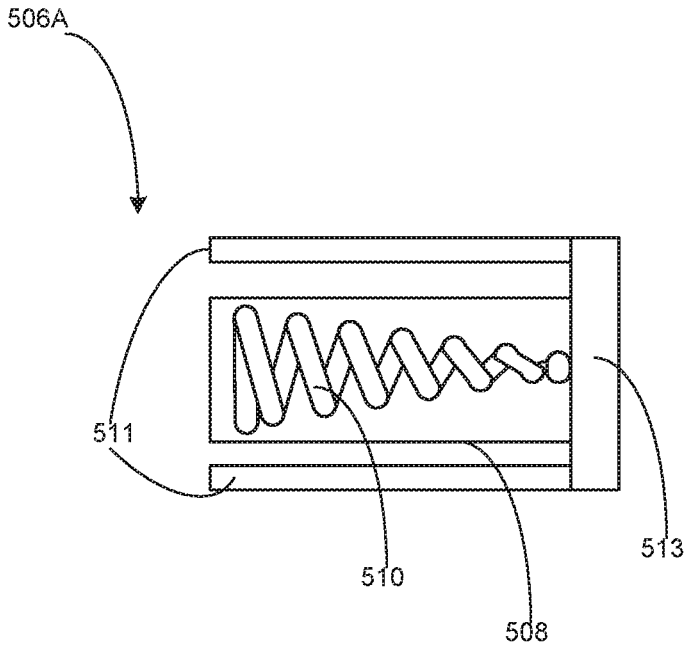
FIG. 5D is an example cross-section of one of the filament assemblies, in accordance with various embodiments.

FIG. 5D is an example cross-section of one of the filament assemblies 506, in accordance with various embodiments. In this example, the filament assembly 506A includes the containment vessel 508 surrounding the filament 510. The filament assembly 506A can include an end cap 513 (e.g., of ceramic substance). The filament 510 can be wounded. The filament assembly 506A can have reflector 511 external to and surrounding the containment vessel 508. In some embodiments, the reflector 511 can be attached to the end cap 513. In some embodiments, the reflector 511 is not attached to the end cap 513 (not shown).

A computing device (e.g., the computing device 206) can be configured to control the emission spectral power distribution (e.g., including one or more peak emission wavelengths) of the filament assemblies 506, individually, in subsets, or as a whole. For example, the computing device can be configured to identify a food profile associated with food (e.g., in the chamber 502) based on sensor input (e.g., camera scanning a label) and/or the user input. The computing device can then determine one or more excitable wavelengths associated with the food profile. For example, the excitable wavelengths can correspond to resonant frequencies of the food material(s) associated with the food profile. The computing device can drive one or more (e.g., a single assembly up to all) of the filament assemblies 506 to emit at a peak emission wavelength corresponding to at least one of the excitable wavelengths to heat the food.

In some embodiments, the chamber 502 is entirely enclosed in metal. In some embodiments, the chamber 502 has the door. In some embodiments, the chamber 502 has one or more transparent windows (e.g., glass windows). In some embodiments, one or more perforated metal sheets 512 (e.g., a perforated metal sheet 512A and/or a perforated metal sheet 512B, collectively as the "perforated metal sheets 512") are disposed within the chamber 502. In some embodiments, there is only a single perforated metal sheet in the chamber 502 (e.g., above the cooking platform 516 or below the cooking platform 516). In some embodiments, there are two perforated metal sheets (as shown). Each of the perforated metal sheets 512 can be a removable or affixed panel. The perforated metal sheets 512 can enable control of heating concentration along a horizontal plane parallel its surface. Perforated metal sheets, such as a perforated aluminum foil, can be used to shield certain food items from the intense radiant heat generated by the filament assemblies 506. For example, when cooking a steak and vegetables side-by-side, the perforated metal sheets can shield the vegetables from being overcooked and enable the steak to receive the full power from the filament assemblies 506. Longer wavelength emission from the filament assemblies 506 can penetrate perforations more equally compared to shorter wavelength. Hence even if the perforations were designed to shield, for example, 90% of direct radiant heat, the cooking instrument can still independently tune the spatial concentration of the heating by varying the wavelength. This enables some control of side-by-side cooking in addition to direct radiant heating.

In some embodiments, the filament assemblies 506 are adapted to emit directional electromagnetic waves. Directionality of the emitted waves can enabled by the shape and/or location of the reflector 511, the structure, shape, and/or location of the containment vessel 508, the structure and/or shape of the filament 510, or any combination thereof. In some embodiments, the perforated metal sheets 512 further restricts the spatial concentration of the emitted waves. In some embodiments, at least some of the filament assemblies 506 are adapted to emit unidirectional electromagnetic waves.

In some embodiments, the chamber 502 includes the cooking platform 516 (e.g., the cooking platform 110) in the chamber 502. In some embodiments, the cooking platform 516 includes or is part of at least one of the one or more perforated metal sheets 512. The computing device can be configured to drive the filament assemblies 506 to emit at a spectral power distribution including a peak emission wavelength corresponding to excitable wavelength for the cooking platform 516. By tuning to include the peak emission wavelength to the excitable wavelength of the cooking platform 516, the computing device can heat up the cooking platform 516 without directly heating the air or the food inside the chamber 502.

The cooking platform 516 can be made of glass or metal. The cooking platform 516 can include an optically transparent region, such as via glass or glass-like material, enabling visible light to substantially travel through two opposing surfaces of the cooking platform 516. For example, prior to heating, a user of the cooking instrument 500 can place an instruction sheet beneath the cooking platform 516 while arranging food on the cooking platform 516 to be cooked. The user can directly overlay specific food at the desired location according to the instruction sheet. In some embodiments, the cooking platform 516 includes a reflective portion 518 to enable a top side camera 522 to capture a bottom view of food resting on the cooking platform 516.

In some embodiments, the cooking instrument 500 includes an airflow-based cooling system (e.g., including a cooling unit 520A, a cooling unit 520B, a cooling unit 520C, a cooling unit 520D, a cooling unit 520E, and a cooling unit 520F, collectively as the "cooling system 520"). The airflow-based cooling system 520 can blow directly onto a reflector portion of the containment vessel 508 to cool (e.g., prevent vaporization of the reflective coating) and/or improve performance of the reflector 511. The airflow can be controlled to provide impingement convection heating. The airflow-based cooling system 520 can have an air path that filters steam and thus prevents hot air from escaping when the door of the cooking instrument 500 is opened. The air path can also be configured to go over a camera (not shown) of the cooking instrument 500 to keep the lens of the camera condensation free. In some embodiments, air flow and convection can be achieved through passive, chimney like effects, for example holes or gaps can be installed in reflectors such that air super-heated through bulb/filament containment vessel contact will experience a reduction in density and thus buoyantly flow through such gaps.

In some embodiments, a fan can be installed away from the filament assemblies 506. When the spectral power distribution (including one or more peak wavelengths) of a filament assembly is configured to heat the envelope and/or the containment vessel 508, the fan can stir the air within the chamber 502 to ensure that heated air adjacent to the containment vessels 508 is moved to other parts of the chamber 502 to cook the food.

In some embodiments, the cooking instrument 500 lacks a crumb tray. Optionally, the cooking instrument 500 can use a heat resistant sheet 520 (e.g., quartz or other material) to cover the filament assemblies 506 so that the bottom of the cooking instrument chamber has no filament assemblies to trip over. The heat resistant sheet can be transparent at the operating wavelengths of the filament assemblies 506 to enable for the emission from the filament assemblies 506 to penetrate through without much loss.

In some embodiments, the computing device within the cooking instrument 500 can drive the filament assemblies 506 according to instructions in a cooking recipe. For example, the computing device can drive at least one of the filament assemblies 506 at a peak wavelength. The peak wavelength can correspond to excitable wavelengths of the materials in the cooking platform 516, the containment vessel 508 (e.g., envelope of the filament assembly), a specific type of edible material, water molecules, or any combination thereof. By matching a particular peak wavelength corresponding to an excitable wavelength of a target material, the computing device can target specific material for heating. For example, the computing device can drive at least one of the filament assemblies 506 at a peak wavelength (e.g., 3 μm or above for a glass cooking platform) such that the cooking platform 516 is substantially opaque to waves emitted from the at least one of the filament assemblies 506. The computing device can drive at least one of the filament assemblies 506 at a peak wavelength (e.g., 3 μm or less for glass cooking platforms) such that the cooking platform 516 is substantially transparent to waves emitted from the at least one of the filament assemblies 506. The computing device can drive at least one of the filament assemblies 506 at a peak wavelength (e.g., between 3 μm and 4 μm for glass cooking platforms) such that the cooking platform 516 is heated by waves emitted from the at least one of the filament assemblies 506 without substantially heating any organic food in the cooking chamber.

FIG. 5B is a cross-sectional top view of the cooking instrument 500 of FIG. 5A along lines A-A', in accordance with various embodiments. FIG. 5B can illustrate the perforated metal sheet 512A and cavities within the perforated metal sheet 512A that exposes the cooking platform 516. For example, the perforated metal sheet 512 includes a rectangular cavity 524A and an oval cavity 524B that exposes the cooking platform 516 underneath.

FIG. 5C is a cross-sectional top view of the cooking instrument 500 of FIG. 5A along lines B-B', in accordance with various embodiments. FIG. 5C can illustrate the cooking platform 516. In embodiments where the cooking platform 516 is transparent or semitransparent, the reflective portion 518 may be visible from the cross-sectional top view.

In some embodiments, the cooking platform 516 can be virtually divided into cooking target zones (e.g., zone 528A, zone 528B, zone 528C, and zone 528D, collectively as the "cooking target zones 528"). That is, food cooking recipes and heating sequences can reference these cooking target zones 528. Each of the cooking target zones 528 can be defined by physically visible perimeters (e.g., a zone A perimeter 530A, a zone B perimeter 530B, a zone C perimeter 530C, and a zone D perimeter 530D, collectively as the "visible perimeters 530"). The visible perimeters 530 can be of different sizes and shapes (e.g., overall or rectangular). In some embodiments, the visible perimeters 530 can be marked by heat resistant paint. In some embodiments, the visible perimeters 530 can be defined by structural channeled edges or beveled edges in the cooking platform 516. In some embodiments, each of the visible perimeters 530 can be defined by the corresponding cooking target zone being terraced (e.g., elevated or depressed).

In some embodiments, the cooking target zones 528 can include visible labels (e.g., a zone A label 534A, a zone B label 534B, a zone C label 534C, and a zone D label 534D, collectively as the "visible labels 534"). The visible labels 534 can advantageously provide a clear reference for a user to know where to place portions of food as instructed by the cooking instrument 500 (e.g., via displayed information related to instructions associated with a cooking recipe).

Figure 6:
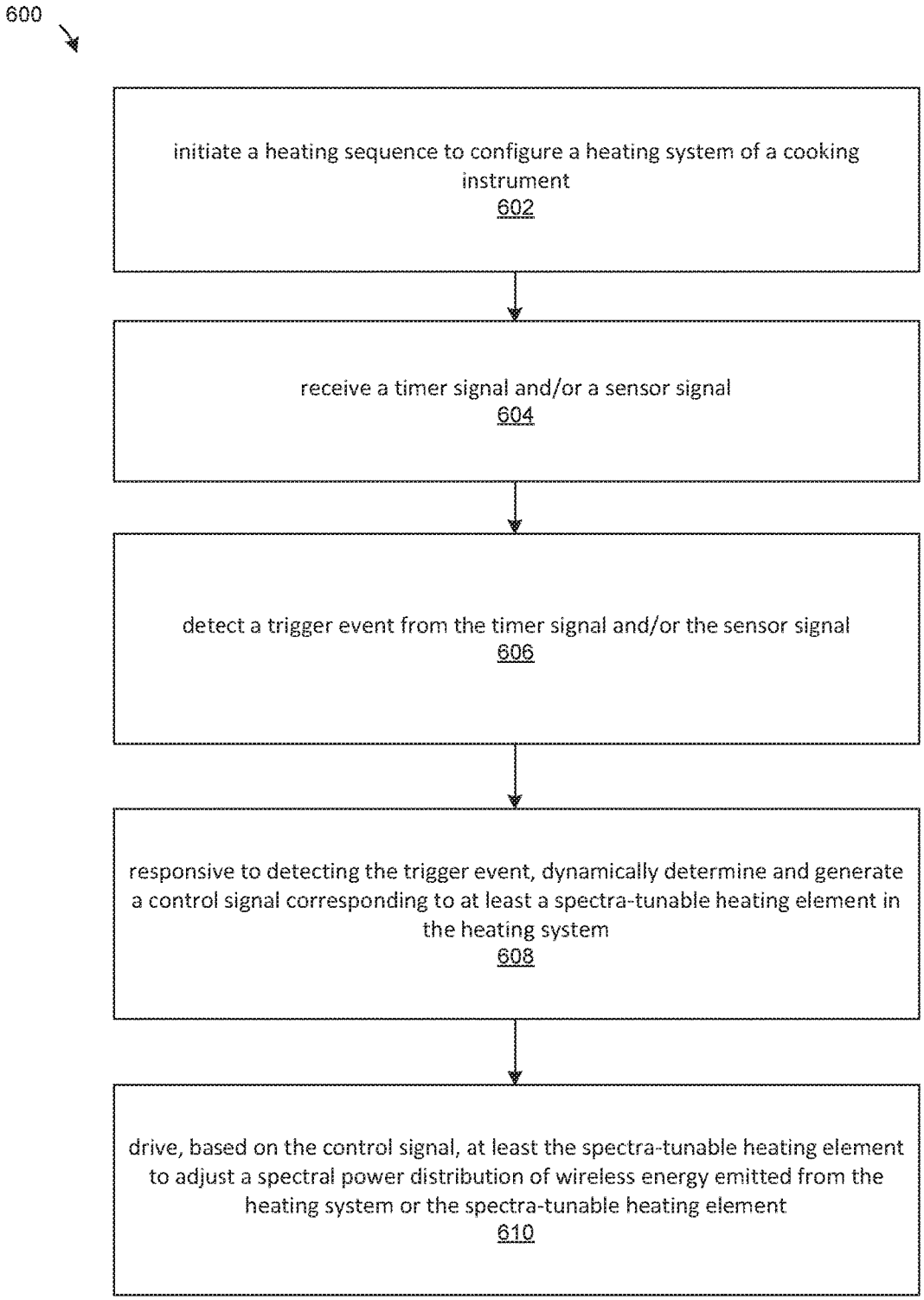
FIG. 6 is a flow chart illustrating a method of operating a cooking instrument, in accordance with various embodiments.

FIG. 6 is a flow chart illustrating a method 600 of operating a cooking instrument (e.g., the cooking instrument 100, the cooking instrument 200, and/or the cooking instrument 500), in accordance with various embodiments. The method 600 can be executed by a control system (e.g., the computing device 206) of the cooking instrument. At step 602, the control system can initiate a heating sequence to configure a heating system (e.g., the heating system 216) of the cooking instrument. For example, configuration of the heating system includes configuration of individual spectra-tunable heating elements. The heating sequence can include instructions to configure at least a spectra-tunable heating element of the heating system.

At step 604, the control system can then receive a timer signal and/or a sensor signal. The timer signal can be a continuous data stream of time indicators or discrete data packets (e.g., periodic or otherwise) indicative of time. The sensor signal can be a continuous data stream of sensor measurements or discrete sensor measurements (e.g., periodic or otherwise). The continuous data streams can be un-interrupted while the heating system is operating.

At step 606, the control system can detect a trigger event from the timer signal and/or the sensor signal. Responsive to detecting the trigger event, at step 608, the control system can dynamically determine and generate a control signal corresponding to at least the spectra-tunable heating element in the heating system. At step 610, the control system can drive, based on the control signal, at least the spectra-tunable heating element to adjust a spectral power distribution of wireless energy emitted from the heating system or the spectra-tunable heating element. Driving the heating system can include adjusting the spectral power distribution of the wireless energy by selectively turning off or selectively reducing intensity of power supplied to the at least one heating element in the heating system.

In some embodiments, the heating system adjusts the spectral power distribution while preserving the total output power of the heating system, such as by increasing an output intensity for a first wavelength spectrum while reducing an output intensity for a second wavelength spectrum. In some embodiments, the heating system adjusts the spectral power distribution without preserving the total output power. The first wavelength spectrum can be longer or shorter than the second wavelength spectrum. In the case that the first wavelength spectrum is longer, the heating system or the spectra-tunable heating element essentially targets direct heat transfer to a material with an absorption band that is longer in wavelength. In the case that the first wavelength spectrum is shorter, the heating system or the spectra tunable heating element essentially targets direct heat transfer with an absorption band that is shorter in wavelength.

In some embodiments, adjusting the spectral power distribution includes adjusting spectral power distribution of wireless energy emitted from only a subset of heating elements in the heating system. Here, "only a subset" means less than all of the heating elements in the heating system.

Figure 10:
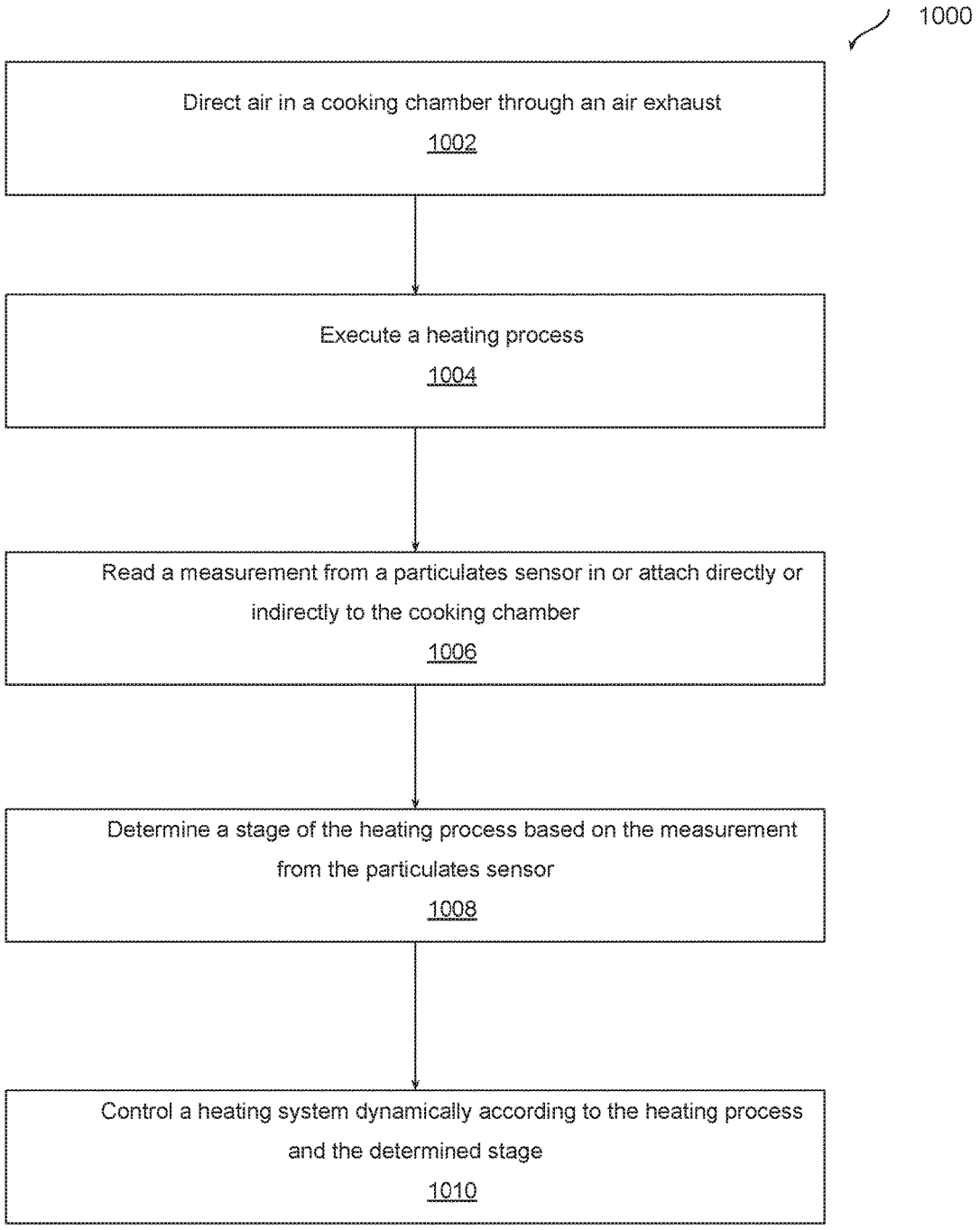
FIG. 10 is a flow chart illustrating a method of operating a cooking instrument, in accordance with various embodiments.

FIG. 10 is a flow chart illustrating a method 1000 of operating a cooking instrument (e.g., the cooking instrument 100, the cooking instrument 200, and/or the cooking instrument 500), in accordance with various embodiments.

At step 1002, the cooking instrument can direct air in a cooking chamber through an air exhaust. In some embodiments, the cooking instrument can direct air passively (e.g., relying on the air pressure inside the cooking chamber to push out the air through the exhaust). In some embodiments, the cooking instrument can actively direct the air via an air movement device. At step 1004, a controller of the cooking instrument can execute a heating process. At step 1006, the cooking instrument can read a measurement from a particulates sensor in or attach directly or indirectly to the cooking chamber. The particulates sensor can be positioned within the cooking chamber such that air passing toward the air exhaust flows over the particulates sensor. The sensor can be adapted to detect particles given off by food under heat.

At step 1008, the controller can determine a stage of the heating process based on the measurement from the particulates sensor. At step 1010, the controller can control a heating system dynamically according to the heating process and the determined stage.

While processes or methods are presented in a given order, alternative embodiments may perform routines having steps, or employ systems having blocks, in a different order, and some processes or blocks may be deleted, moved, added, subdivided, combined, and/or modified to provide alternative or sub-combinations. Each of these processes or blocks may be implemented in a variety of different ways. In addition, while processes or blocks are at times shown as being performed in series, these processes or blocks may instead be performed in parallel, or may be performed at different times. When a process or step is "based on" a value or a computation, the process or step should be interpreted as based at least in part on that value or that computation.

Some embodiments of the disclosure have other aspects, features, structures, characteristics, and steps (collectively "elements") in addition to or in place of what is described above. These potential additions and replacements are described throughout the rest of the specification. Reference in this specification to "various embodiments" or "some embodiments" means that a particular element described in connection with the embodiment is included in at least one embodiment of the disclosure. Alternative embodiments (e.g., referenced as "other embodiments") are not mutually exclusive of other embodiments. Moreover, various elements are described which may be exhibited by some embodiments and not by others. Similarly, various requirements are described which may be requirements for some embodiments but not other embodiments.

Some embodiments of this disclosure references an element sharing a similarly name or label of another element described in other examples or embodiments of the disclosure. References to such an element (even without figure numbering) means that the the other element with substantially similar name or label is an open-ended example or potential replacement of the referenced element provided that such example and replacement is not inconsistent with the embodiment in question.

Some embodiments of the disclosure have other aspects, elements, features, and steps in addition to or in place of what is described above. These potential additions and replacements are described throughout the rest of the specification.

The invention claimed is:

1. A cooking instrument comprising:

a heating system including a heating element;

a cooking chamber with an air exhaust;

a sensor positioned within the cooking chamber such that air passing toward the air exhaust flows over the sensor, wherein the sensor is adapted to detect particles given off by food under heat, wherein the sensor includes a light sensor and a light emitter, and wherein the sensor is capable of detecting in-air particles based on measurement of light scattering from a volume of air over the light sensor when the light emitter is emitting light toward the volume of air; and a controller configured to execute a heating process, to determine a stage of the heating process based on sensor data from the sensor, and to control the heating system dynamically according to the heating process and the determined stage.

2. The cooking instrument of claim 1, wherein a flow control structure within the cooking chamber substantially limits velocity of the air passing toward the air exhaust.

3. The cooking instrument of claim 1, wherein the controller is configured to determine the stage of the heating process by at least determining a thermal state of a target food in the cooking chamber.

4. The cooking instrument of claim 1, further comprising a cooking platform to support a target food in the cooking chamber; wherein the controller is configured to determine the stage of the heating process by at least determining a thermal state of the cooking platform within the cooking chamber.

5. The cooking instrument of claim 1, wherein the controller is configured to determine the stage of the heating process by at least determining quantity of a particular type of particles in the air passing over the sensor.

6. The cooking instrument of claim 5, further comprising a temperature sensor adapted to measure temperature data; and wherein the controller is configured to determine either the quantity of the particular type of particle or the stage of the heating process based on the sensor data and the temperature data.

7. The cooking instrument of claim 5, further comprising a humidity sensor adapted to measure humidity data; and wherein the controller is configured to determine either the quantity of the particular type of particle or the stage of the heating process based on the sensor data and the humidity data.

8. The cooking instrument of claim 5, wherein the particular type of particles corresponds to a size range of particles in the air passing over the sensor.

9. The cooking instrument of claim 5, wherein the controller is configured to determine the stage of the heating process by at least determining a size distribution of particles in the air passing over the sensor.

10. The cooking instrument of claim 5, wherein the controller is configured to determine the stage of the heating process by at least computing a particle size quantity ratio, wherein the particle size quantity ratio is a ratio between a first quantity of a first particle size range and a second quantity of a second particle size range.

11. The cooking instrument of claim 10, wherein the controller is configured to determine the stage of the heating process by at least identifying a food transformation event based on the computed particle size quantity ratio.

12. The cooking instrument of claim 11, wherein food transformation event includes burning of a particular material, searing on a particular surface, phase transformation of a particular material, or any combination thereof.

13. The cooking instrument of claim 5, wherein the controller is configured to assign two or more zones in the cooking chamber, and wherein the heating process includes focusing heat from the heating system on each of the zones until a certain quantity of the particle type is reached.

14. The cooking instrument of claim 1, further comprising a camera; wherein the controller is configured to determine the stage of the heating process by at least analyzing an image captured by the camera, and wherein the sensor is adapted to be substantially invisible to the camera.

15. The cooking instrument of claim 1, wherein the pulse oximetry sensor utilizes a first emitter corresponding to a first wavelength spectrum of light and a second emitter corresponding to a second wavelength spectrum of light.

16. The cooking instrument of claim 15, wherein the controller is configured to determine the stage of the heating process by at least determining a ratio between absorbance levels of light at the first wavelength spectrum and light at the second wavelength spectrum.

17. The cooking instrument of claim 1, further comprising a memory storing a known air speed; wherein the controller is configured to compute average particle size in the air based on the sensor data and the known air speed.

18. The cooking instrument of claim 1, further comprising a memory storing an environment profile and an alert configuration, wherein the controller is configured to generate an alert based on cumulative processing of the sensor data over time and the environment profile.

19. The cooking instrument of claim 1, wherein controller is configured to detect smoke based on the sensor data, determine whether the smoke is detected within a predetermined time after turning on the heating element, and identify the heating element as dirty in response to determining the smoke is detected within the predetermined time.

20. The cooking instrument of claim 1, wherein the controller is configured to compute a position of burning substance based on the sensor data and a timestamp associated with an instruction to the heating system.

21. A cooking instrument comprising:

a heating system including a heating element;

a cooking chamber with an air exhaust;

a sensor positioned within the cooking chamber such that air passing toward the air exhaust flows over the sensor, wherein the sensor is adapted to detect particles given off by food under heat;

a cooking platform to support a target food in the cooking chamber; and a controller configured to execute a heating process and to determine a stage of the heating process based on sensor data from the sensor, wherein the controller is configured to determine the stage of the heating process by at least determining a thermal state of the cooking platform within the cooking chamber.

22. A cooking instrument comprising:

a heating system including a heating element;

a cooking chamber;

a sensor such that air within the cooking chamber flows over the sensor, wherein the sensor is adapted to detect particles given off by food under heat; and a controller configured to execute a heating process and to determine a stage of the heating process based on sensor data from the sensor, wherein the controller is configured to determine the stage of the heating process by at least determining quantity of a particular type of particles in the air passing over the sensor and the particular type of particles corresponds to a size range of particles in the air passing over the sensor.

* * * * *